US006742439B2

(12) United States Patent
Matsuda et al.

(10) Patent No.: US 6,742,439 B2
(45) Date of Patent: Jun. 1, 2004

(54) VARIABLE DISPLACEMENT COMPRESSOR

(75) Inventors: Mikio Matsuda, Okazaki (JP); Naruhide Kimura, Okazaki (JP); Mitsuo Inagaki, Okazaki (JP); Shigeru Hisanaga, Kariya (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 10/151,876

(22) Filed: May 22, 2002

(65) Prior Publication Data

US 2002/0174765 A1 Nov. 28, 2002

(30) Foreign Application Priority Data

May 22, 2001 (JP) ..... 2001-153094
May 22, 2001 (JP) ..... 2001-153095

(51) Int. Cl.[7] ..... F09B 25/08
(52) U.S. Cl. ..... 92/12.2; 417/222.2
(58) Field of Search ..... 92/12.2, 71; 417/269, 417/222.1, 222.2

(56) References Cited

U.S. PATENT DOCUMENTS 3,761,202 A * 9/1973 Mitchell ..... 417/269
4,175,915 A * 11/1979 Black et al. ..... 417/269
4,221,545 A * 9/1980 Terauchi ..... 417/269
4,236,878 A * 12/1980 Terauchi ..... 417/269
4,290,345 A * 9/1981 Hiraga et al. ..... 417/269
4,664,604 A * 5/1987 Terauchi ..... 47/222.2
4,723,891 A 2/1988 Takenaka et al.
5,105,728 A * 4/1992 Hayase et al. ..... 92/71
6,179,571 B1 * 1/2001 Kawachi et al. ..... 92/12.2
6,260,469 B1 * 7/2001 Ahn ..... 92/71
6,402,481 B1 * 6/2002 Ahn ..... 92/12.2

FOREIGN PATENT DOCUMENTS

JP A-62-203980 9/1987
JP A-62-225782 10/1987
JP A-2-149776 6/1990

* cited by examiner

*Primary Examiner*—Thomas E. Lazo
(74) *Attorney, Agent, or Firm*—Posz & Bethards, PLC

(57) ABSTRACT

A variable displacement compressor includes a linking groove, which forms a hinge for connecting an arm and an inclining member. The groove is generally U-shaped (open). A link pin is fitted in the groove such that the link pin can pivot or slide within the groove. As a result, installation of a movable parts assembly, which is done by inserting the link pin into the groove, is easier. A controlled pressure chamber improves the response of the compressor to controls.

19 Claims, 25 Drawing Sheets

VARIABLE DISPLACEMENT COMPRESSOR

CROSS REFERENCES TO RELATED APPLICATIONS

This application relates to and incorporates by reference Japanese patent application no. 2001-153094, which was filed on May 22, 2001, and Japanese patent application no. 2001-153095, which was filed on May 22, 2001.

BACKGROUND OF THE INVENTION

The present invention relates to a variable displacement compressor in which the theoretical discharge rate (the flow rate determined by stroke and bore diameter) is changed by changing the strokes of a plurality of reciprocating pistons. This is done by changing the inclination of an inclining member, such as a swash plate or an oscillating plate, which is inclined relative to the axis of a shaft. Variable displacement-compressors are suited for a vapor-compression type refrigeration cycles for vehicles (vehicle air conditioners).

A variable displacement compressor disclosed in Japanese unexamined patent publication (JP-A) no. Sho 62-225782 includes an elongated linking groove (linking aperture) at the front side of an arm that extends radially from a shaft. The inclining member is linked to the arm such that oscillation of an inclining member is possible due to a link pin passing through the linking groove.

When assembling the variable displacement compressor, it is necessary to install the inclining member on the arm while a plurality of pistons is connected to the inclining member. However, the size of the crankcase (housing) is usually made no larger than necessary for accommodating the inclining member, because it takes more time to change the pressure inside the crankcase when the size (volume) of the housing (especially, the crankcase accommodating the inclining member) increases. Thus, it is difficult to install the inclining member, because the freedom of movement of the inclining member is, in general, comparatively low during the installation.

With regard to variable displacement compressors that change the inclination angle of an inclining member, such as a swash plate or an oscillating plate, the inclination angle of the inclining member is generally controlled by controlling the pressure inside a swash plate chamber (crankcase), as disclosed in Japanese unexamined patent publication (JP-A) No Sho. 62-203980 or Japanese unexamined patent publication (JP-A) No. Sho. 62-240482.

The capacity of the swash plate chamber (crankcase) is comparatively large, since it accommodates the inclining member. As a result, a comparatively large amount of gas is needed to control the pressure inside the crankcase (this pressure is referred to as the control pressure), and there is a comparatively large time lag until the actual control pressure changes, subsequent to the actuation of the control valve (the control signal of the control valve) that controls the control pressure.

Therefore, there is a delay in response until the theoretical discharge flow rate, or displacement, actually changes, and it is difficult to control the displacement with precision.

Blow-by gas (gas leaking between the cylinder bores and the pistons) flows into the crankcase, and this problematically changes the displacement (decreases the displacement) even though the control valve has not been activated, by increasing the pressure inside the crankcase. Thus, there is a need for a compressor that is more responsive to controls.

SUMMARY OF THE INVENTION

The present invention was made in view of the above-mentioned problems, and it is an object of this invention to improve assembly, when connecting an inclining member, with a plurality of pistons attached, to an arm. It is a further object to provide a compressor with improved responsiveness.

In order to accomplish these objects, one aspect of the present invention provides a variable displacement compressor that changes a theoretical discharge by changing strokes of a plurality of reciprocating pistons (112), which in turn is done by changing an inclining member (108, 110) inclined relative to a center axis ($L_O$) of a shaft (106), and by changing an inclination angle ($\theta$) between the centerline ($L_O$) and the inclining members (108, 110). The variable displacement compressor is provided with a housing (101, 102, and 105) that accommodates the shaft (106) and the inclining member (108, 110), and the housing is also provided with a plurality of cylinder bores (103) for accommodating the pistons (112). The variable displacement compressor is also provided with an arm (106*a*), onto which the inclining member (108, 110) is linked, such that the inclining member (108, 110) can move radially from the centerline ($L_O$), and which transmits rotating force of the shaft (106) to the inclining member (108, 110). A coupling between the arm (106*a*) and the inclining member (108, 110) includes a linking groove (108*b*) provided on one of the arm (106*a*) and the inclining member (108, 110), and a link pin (109) fixed on the other of the arm and the inclining member, such that the pin can slide within the linking groove (108*b*). The linking groove (108*b*), is open, with an opening (108*c*) provided at one end of the linking groove.

As a result, the assembly process is easier, because it is possible to easily connect the inclining member (108, 110), when a plurality of pistons (112) is attached to, the arm (106*a*), by inserting the link pin (109) into the linking groove (108*b*), from the opening portion (108*c*) of the linking groove (108*b*), even when the degree of freedom in movement of the inclining member is relatively restricted.

BRIEF DESCRIPTION OF THE DRAWINGS

These and other objectives and advantages of the present invention will become apparent from the following description with reference to the accompanying drawings, wherein.

DETAILED DESCRIPTION OF THE PREFERRED EMBODIMENTS

First Embodiment

This embodiment is a variable displacement compressor serving as a refrigerant compressor of a vapor-compression type refrigeration, cycle for vehicles (air conditioning apparatus for vehicles).

Figure 1:
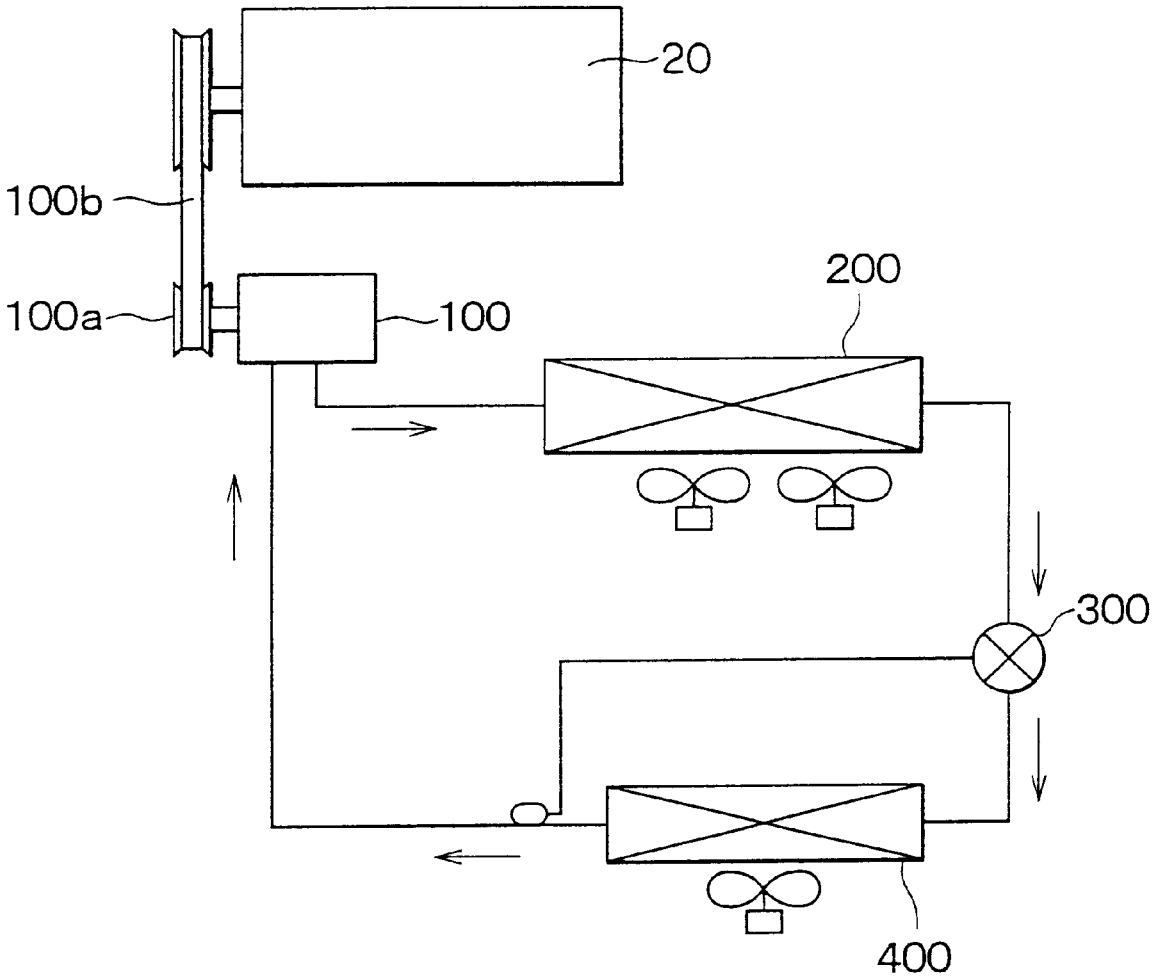
FIG. 1 is a diagram of a vapor-compression type refrigeration cycle using a compressor according to a first embodiment of the present invention.

In FIG. 1, reference symbol 100 denotes a compressor that draws and compresses refrigerant. The compressor 100 is driven by an engine 20, which also powers the vehicle in which the compressor 100 is installed. Reference symbol 100*a* denotes means for transmitting power, such as an electromagnetic clutch that intermittently transmits torque from the engine 20 to the compressor 100 or a pulley that transmits the power continuously. Reference symbol 100*b* denotes a V-belt for transmitting power from the engine to the compressor 100.

Reference symbol 200 denotes a condenser (radiator) that condenses (cools) the refrigerant by transferring heat from the refrigerant discharged from the compressor 100 to the outside air. Reference symbol 300 denotes a decompressor that decompresses the refrigerant flowing from the condenser 200. Reference symbol 400 denotes an evaporator that cools air blowing into the passenger compartment, by evaporating the refrigerant that has been decompressed by the decompressor 300, such that heat is transferred to the refrigerant from the air blowing into the passenger compartment.

In this embodiment, a thermostatic expansion valve is employed for the decompressor 300. The opening size of the thermostatic expansion valve is adjusted so that the degree; of heating of the refrigerant that is drawn into the compressor 100 is regulated to a prescribed value. Lubricating oil (refrigerating machine oil) is mixed into the refrigerant, and the mixed lubricating oil lubricates the movable parts (sliding parts) of the compressor 100

Figure 2:
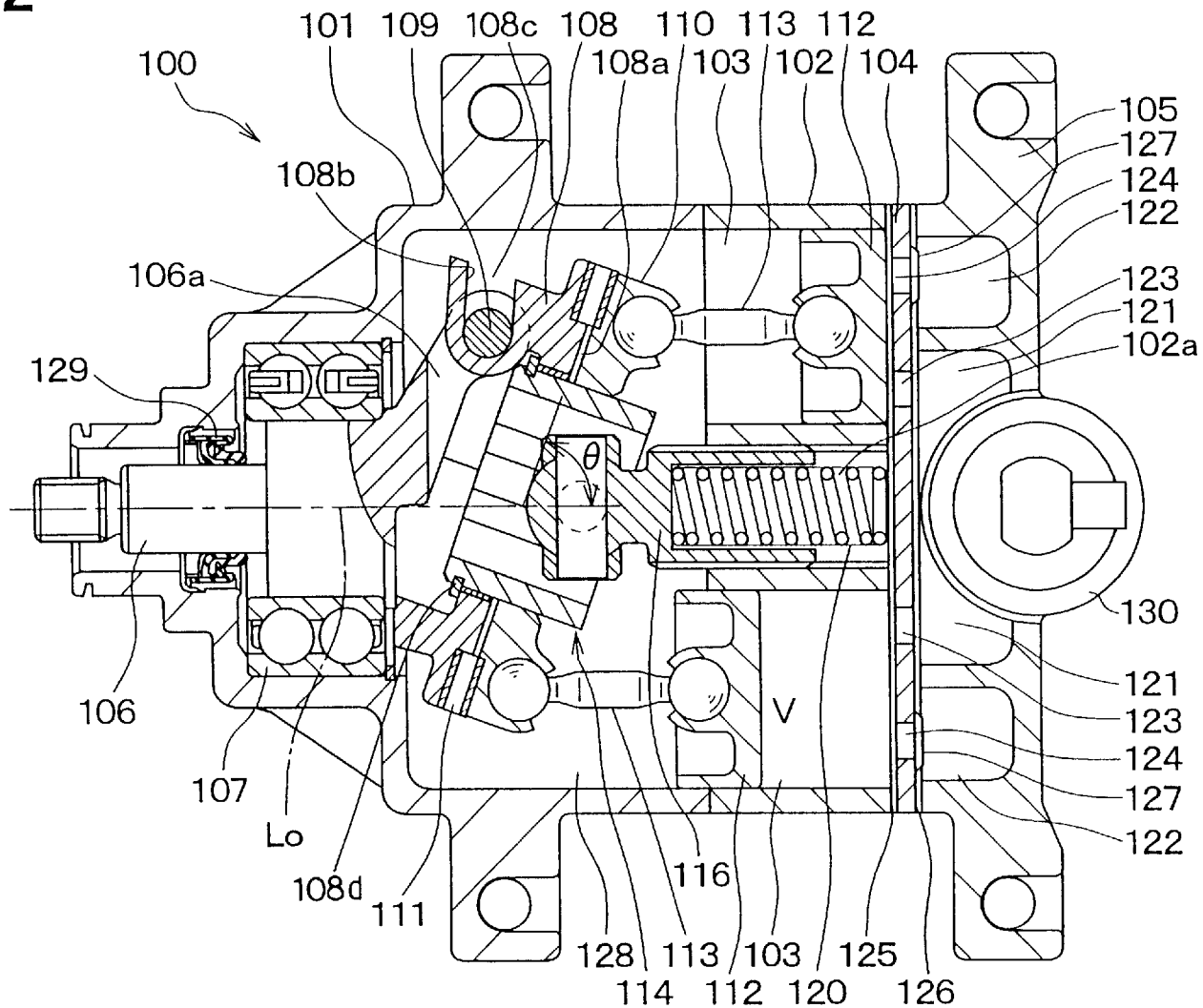
FIG. 2 is a cross sectional view of the compressor according to the first embodiment of this invention, during maximum capacity operation.

FIG. 2 shows the compressor 100, and reference symbol 101 denotes a front housing member (first housing member) made of aluminum, and reference symbol 102 denotes a middle housing member (second housing member) with a plurality of (five in this embodiment) cylinder bores (cylindrical spaces) 103 formed in the middle housing member 102. Reference symbol 104 denotes a valve plate that covers one end of the cylinder bores 103, and the valve plate 104 is sandwiched and fixed between the middle housing member 102 and a rear housing member (third housing member) 105. In this embodiment, the housing of the compressor 100 is constituted by the front housing member 101, the middle housing member 102, and the rear housing member 105.

Reference symbol 106 denotes a shaft that is driven by the vehicle engine (not shown), and the shaft 106 is held within the front housing 101 in a cantilevered state by a radial bearing 107.

Two arms 106*a* extend radially from a center axis $L_0$ of the shaft 106 and are integrally formed with the shaft 106. An inclining member (drive plate) 108 rotates integrally with the shaft 106 and is linked to the front end of the arms 106*a* and can oscillate relative to the arms 106*a*.

The inclining member 108 has an inclining surface 108*a* that inclines relative to the shaft 106, and constitutes an inclining member along with an oscillating member (wobble plate) 110. The inclining member inclines relative to the center axis $L_0$ of the shaft 106.

Reference symbol 109 denotes a link pin constituting a hinge mechanism that links the inclining member 108 to the arms 106*a*, such that the inclining member can pivot about the axis of the pin, and the link pin 109 is fixed to the arms 106*a* by press fitting.

A linking groove 108*b* is formed in the inclining member 108. The link pin 109 engages the linking groove 108*b* such that the inclining member 108 can pivot and slide with respect to the pin 109. The linking groove 108*b* is formed generally in a U-shape (open form) and has an opening 108*c* at one end.

Figure 6:
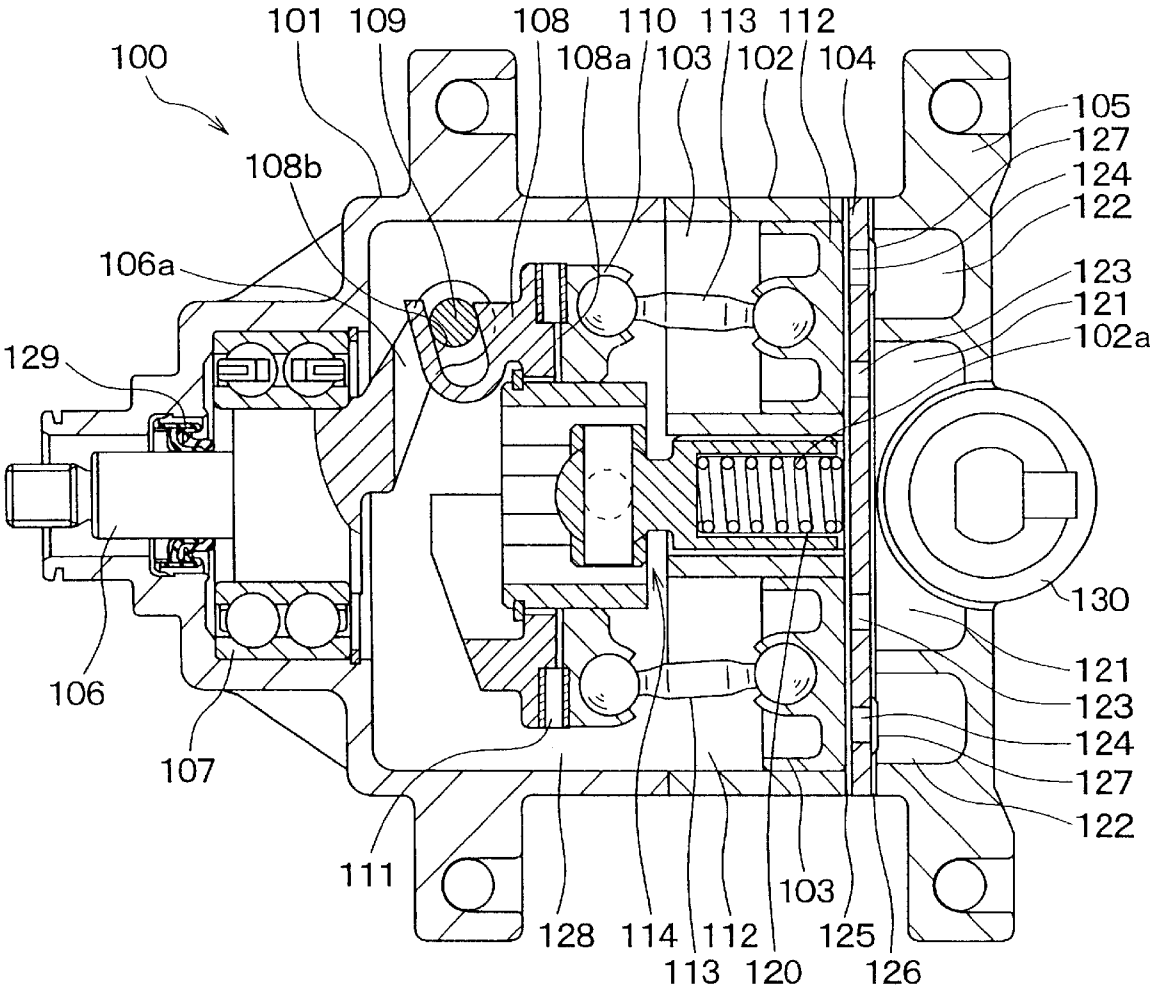
FIG. 6 is a cross sectional view of the compressor according to the first embodiment of the invention, during minimum displacement operation.

When the inclination angle θ (the angle θ between the plane of the inclining surface 108*a* and the center axis $L_0$ of the shaft 106) of the inclining member 108 changes, the link pin 109 slides within the linking groove 108*b* in the longitudinal direction of the groove, which is illustrated in FIG. 6.

Reference symbol 110 denotes an oscillating member (wobble plate), which is annular and which is connected to the inclining surface 108*a* through thrust bearings 111. The oscillating member 110 oscillates with the rotation of the inclining member 108.

The thrust bearings 111 permit the inclining member 108 to rotate relative to the oscillating member 110 around an axis perpendicular to the inclining surface 108*a*. In this embodiment, rolling bearings with cylindrical rollers are preferred for the bearings 111.

Reference symbol 112 denotes a piston reciprocating within the; cylinder bore 103, and reference symbol 113 denotes a rod linking the piston 112 and the oscillating member 110. In this case, one end of the rod 113 is connected to the periphery of the oscillating member 110, where oscillation is great, and the other end is connected to the piston 112. Hence, when the shaft 106 rotates and the oscillating member 110 oscillates, the piston 112 reciprocates inside the cylinder bore 103.

Reference symbol 114 denotes an in the form of a universal joint 20. (Oldham's coupling), which is located centrally of the oscillating member 110. The oscillation support mechanism 114 supports the oscillating member 110 and permits oscillation. The oscillation support mechanism 114 will be described with references to FIG. 3 through FIG. 5.

Reference symbol 115 denotes a first generally annular rotating member, which can be rotated around a first axis $L_1$. The axis $L_1$ intersects the center axis $L_0$ of the shaft 106 at a right angle. Reference symbol 116 denotes a constraining member that is connected to the first rotating member 115, and which prevents the first rotating member 115 from rotating around the center axis $L_0$.

Figure 4:
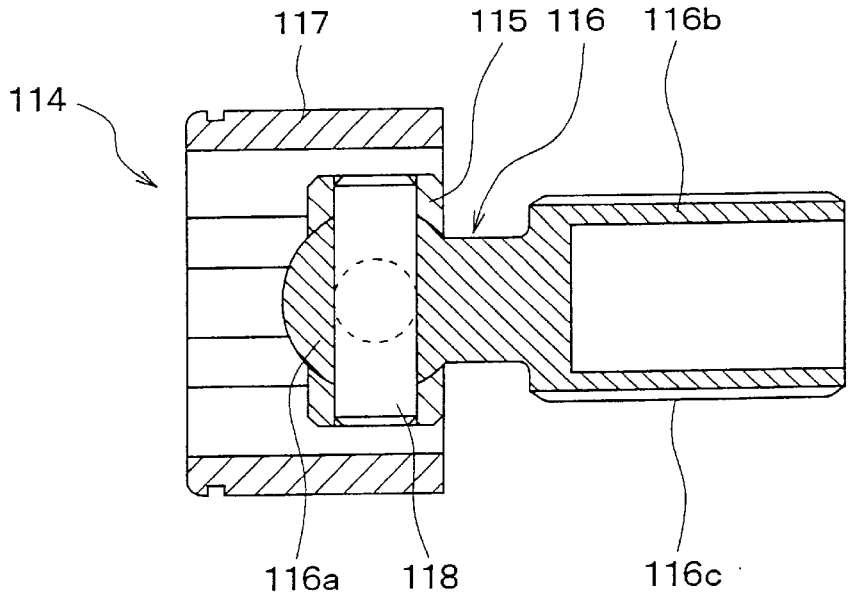
FIG. 4 is a cross sectional view taken along the plane represented by line 4—4 in FIG. 3.
Figure 5:
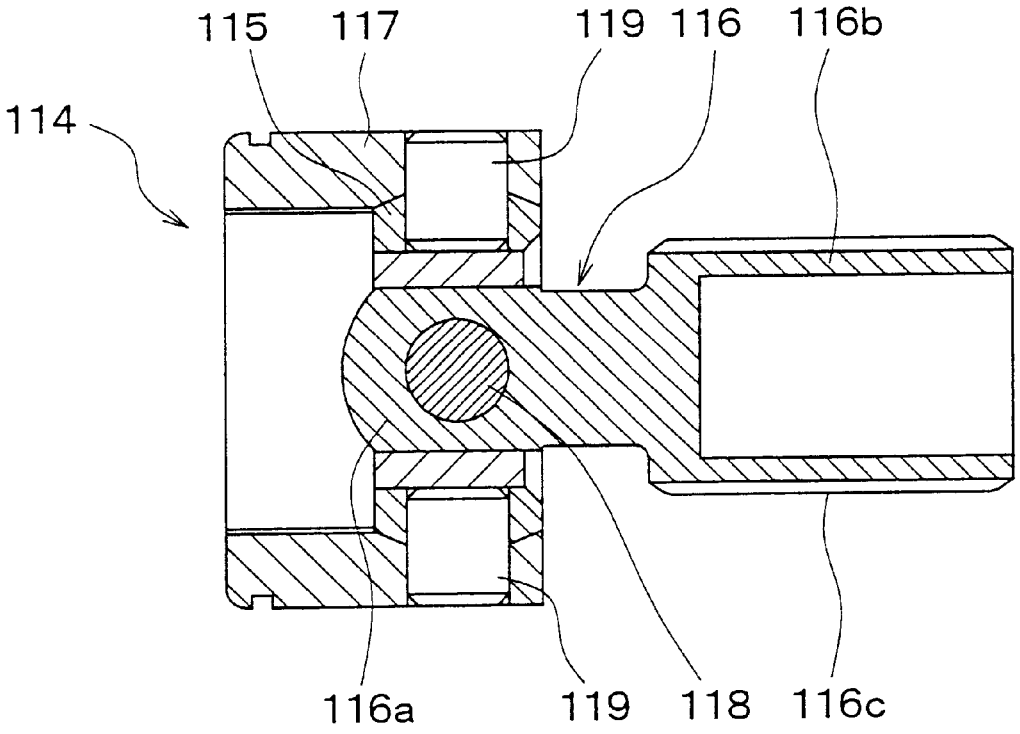
FIG. 5 is a cross sectional view taken along the plane represented by line 5—5 in FIG. 3.

The constraining member 116 includes a head 116*a*, which is located inside the first rotating member 115, and a generally cylindrical supporting portion 116*b*, as shown in FIG. 4. There is a spline 116*c* (refer to JIS B 1601 and others), which is composed grooves extending in the axial direction, provided on the outer surface of the supporting portion 116*b*, and the cross sectional shape of the supporting portion 116*b* is like that of a gear. A generally cylindrical chamber 102*a* is formed inside the middle housing member 102, as shown in FIG. 2. The cross sectional shape of the chamber 102*a* matches that of the constraining member 116.

The constraining member 116 is fitted into the chamber 102*a* such that the constraining member 116 engages the middle housing member 102 and cannot rotate with respect to the middle housing member but can slide axially.

Figure 3:
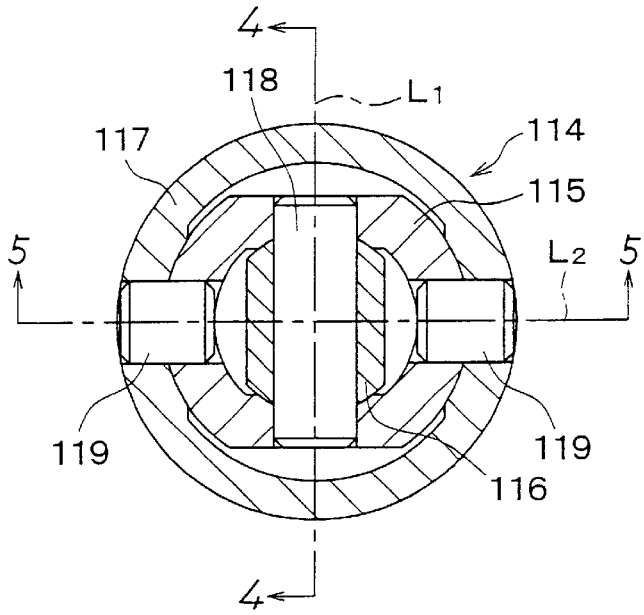
FIG. 3 is a cross sectional view of an oscillation support mechanism of the compressor according to the first embodiment of the invention.

Reference symbol 117 in FIG. 3 denotes a second generally annular rotating member which is located outside of the first rotating member 115. The second rotating member is connected to and can rotate with respect to the first rotating member 115 around a second axis $L_2$, which intersects the center axis $L_0$ and the first axis line $L_1$ at right angles. The oscillating member 110 and the inclining member 108 are press fitted to the second rotating member 117, and the second rotating member is positioned by a snap ring 108*d* (see FIG. 2).

The first rotating member 115 is connected to the head portion 116*a* of the constraining member 116 by a cylindrical pin 118. The second rotating member 117 is linked to the first rotating member 115 through the interposition of a pair of aligned, cylindrical pins 119. A coil spring 120, which exerts an elastic force that pushes the oscillation support member 114 toward the shaft. 106, is located inside the supporting portion 116*b*, as shown in FIG. 2.

The oscillation support mechanism 114 can support the oscillating member 110 because the oscillation support mechanism 114 forms a universal joint.

Reference symbol 121 in FIG. 2 denotes a suction chamber that distributes and supplies refrigerant to, a plurality of actuating chambers V formed by the cylinder bores 103, the valve plate 104, and the pistons 112. Suction ports 123 intermittently connect the suction chamber 121 and the actuating chamber V, and discharge ports 124, intermittently connect the actuating chamber V and a discharge chamber 122. The suction ports 123 and the discharge ports 124 are formed on the valve plate 104.

A reed-type suction valve 125 is provided at each suction port 123, which prevents refrigerant from back flowing from the actuating chamber V to the suction chamber 121. There is also a reed-type discharge valve 126, which prevents refrigerant from back flowing from the discharge chamber 122 to the actuating chamber V, at each discharge port 124.

The suction valves 125 and the discharge valves 126 are sandwiched and fixed between the middle housing member 102 and the rear housing member 105, along with a valve stopper plate (stopper) 127, which regulates the maximum opening of the discharge valve 126. Reference symbol 129 denotes a shaft-seal, which prevents refrigerant inside the crankcase (space 128 that accommodates the oscillating member 110) from escaping through the gap between the front housing member 101 and the shaft 106.

Reference symbol 130 denotes a control valve that controls the pressure in the crankcase 128, by adjusting the communication between the chamber 102*a* and the suction chamber 121 or the discharge chamber 122. The crankcase 128 is connected to the suction chamber 121 through a passage (not shown) that has a prescribed pressure loss (passage resistance).

The following is a description of the operation of the compressor 100.

Operation at Maximum Capacity

Referring to FIG. 2, pressure inside the crankcase 128 is made lower than the discharge pressure (pressure inside the actuation chamber V), by adjusting the pressure control valve 130. Considering one piston 112 in the compressing process, among the five pistons 112, a force in the direction of expanding the volume of the actuating chamber V (called the compression reaction force), is applied to the oscillating member 110 (inclining member 108), because the pressure inside the actuating chamber V is higher than the pressure inside the crankcase 128.

A moment, centered on the link pin 109, is applied in a direction that reduces the inclination angle θ (called inclining moment) to the oscillating member 110 (and to the inclining member 108), by the compression reaction force, because the oscillating member 110 is constrained by the oscillation support member 114. As a result, the inclination angle θ of the oscillating member 110 decreases, and the stroke of the piston 112 increases, which increases the displacement and the discharge rate. The discharge rate refers to the theoretical volume flow (geometric flow rate calculated by stroke and bore diameter) discharged during one rotation of the shaft 106.

Operation With Variable Capacity

Referring to FIG. 6, when reducing the displacement, the pressure inside the crankcase 128 is increased with respect to that of maximum capacity operation by adjusting the pressure control valve. As a result, the compression reaction force (inclining moment) becomes smaller, and the inclination angle θ is increased, which reduces the displacement and the discharge rate.

A procedure for installing movable members, such as the inclining member 108 or the oscillating member 110, will be described in the following.

Figure 7:
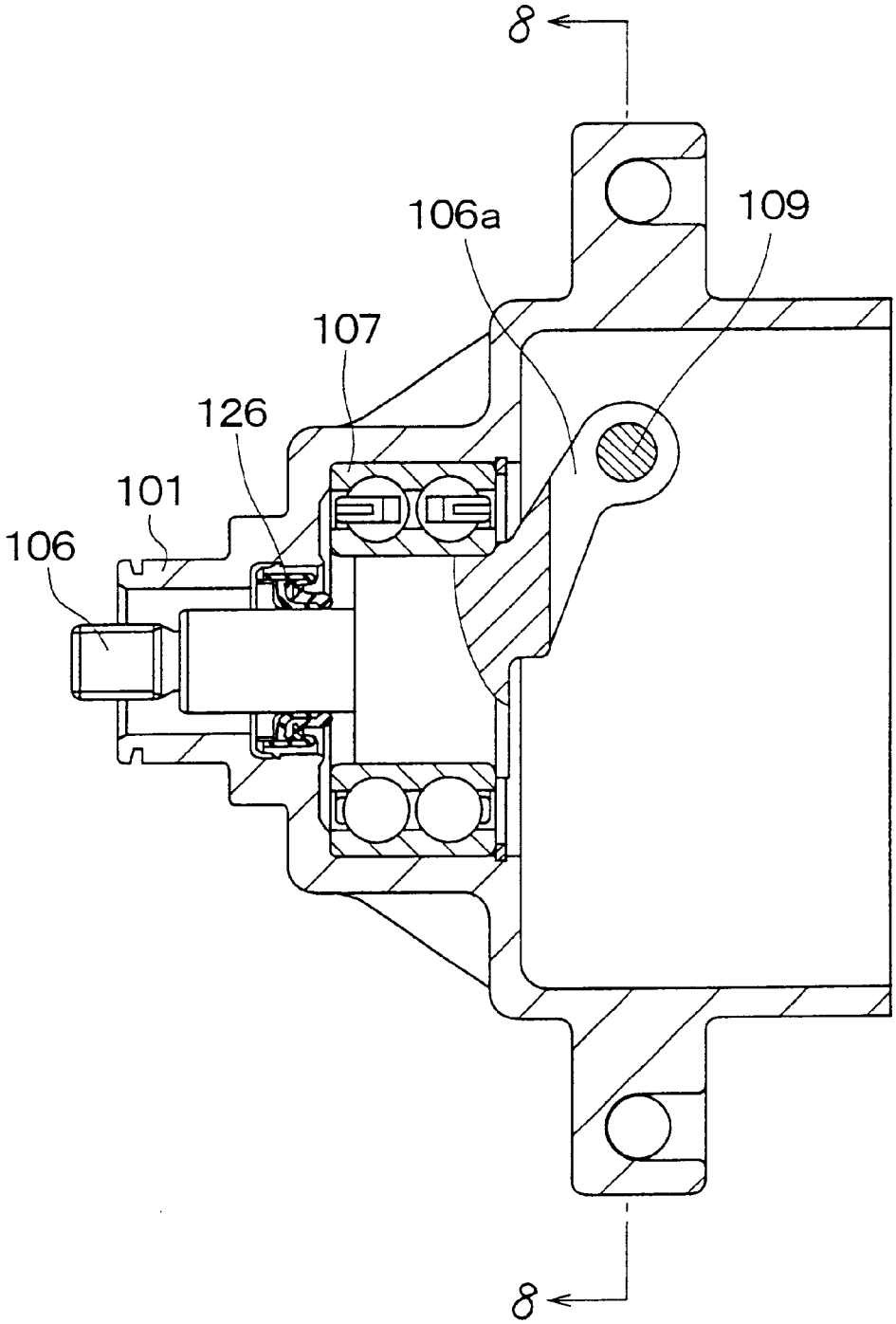
FIG. 7 is a cross sectional view showing a front assembly of the compressor according to the first embodiment of the invention.
Figure 8:
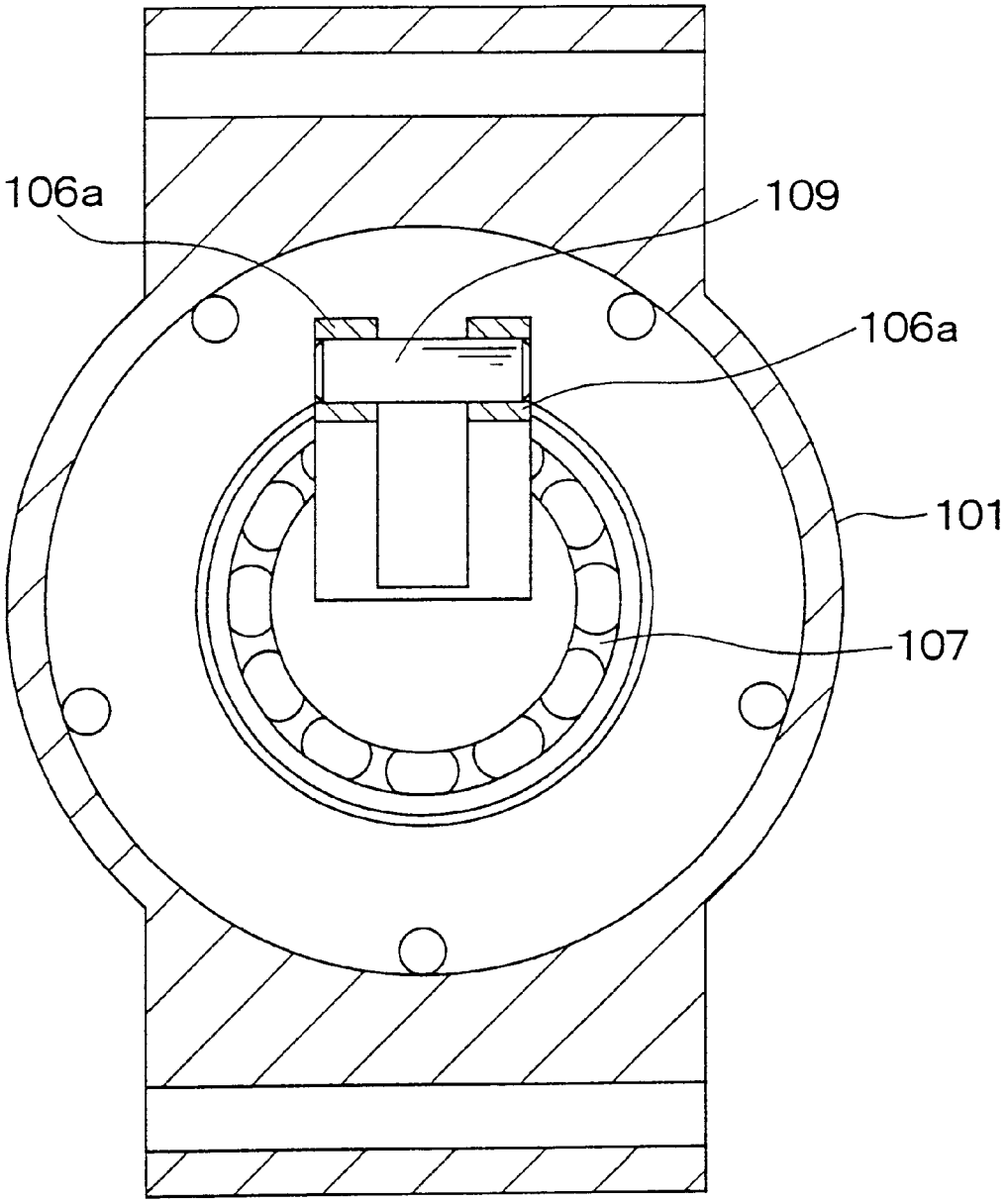
FIG. 8 is a cross sectional view taken along the plane represented by line 8—8 in FIG. 7.
Figure 9:
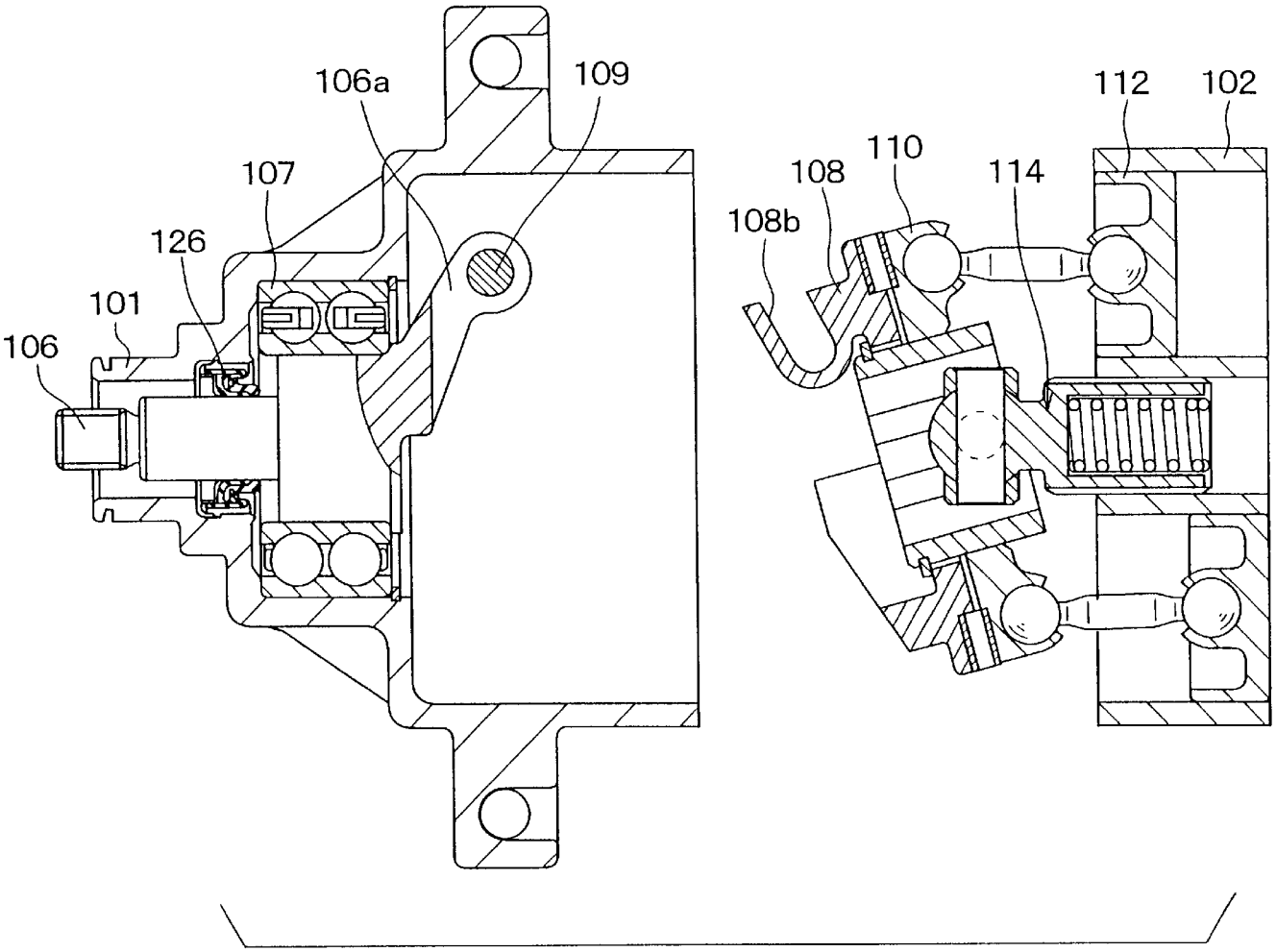
FIG. 9 is a cross sectional assembly view illustrating how a movable portion assembly of the compressor according to the first embodiment of the invention is connected to the front assembly.
Figure 10:
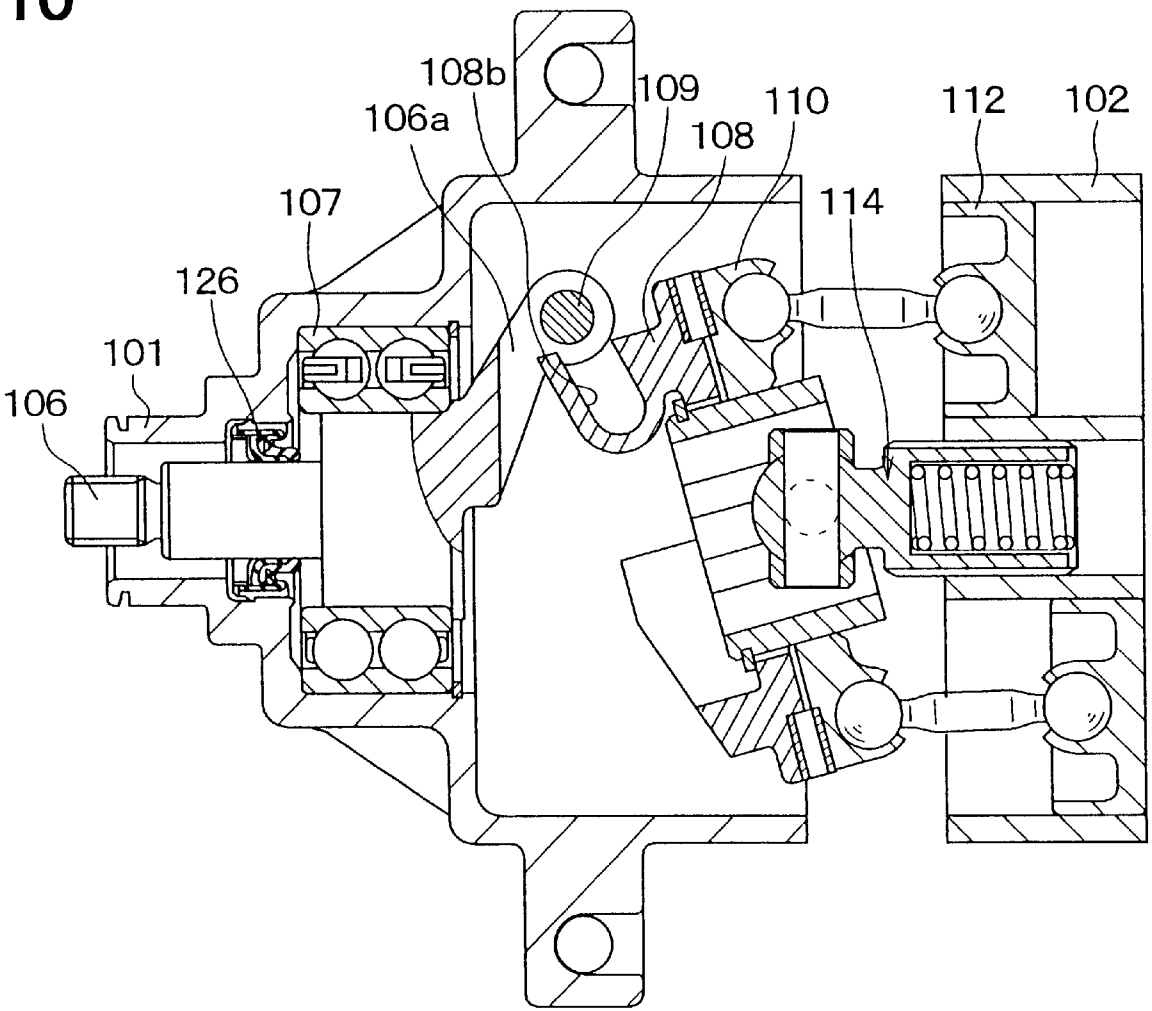
FIG. 10 is a cross sectional assembly view showing how a movable portion assembly of the compressor according to the first embodiment of the invention is connected to the front assembly.
Figure 11:
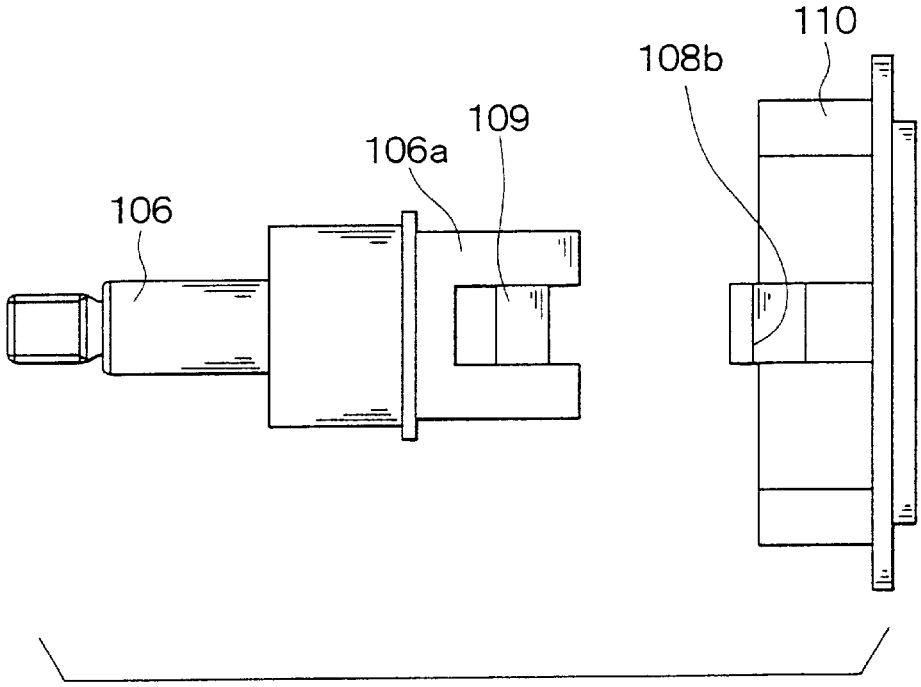
FIG. 11 is a partial plan view corresponding to the view of FIG. 9.
Figure 12:
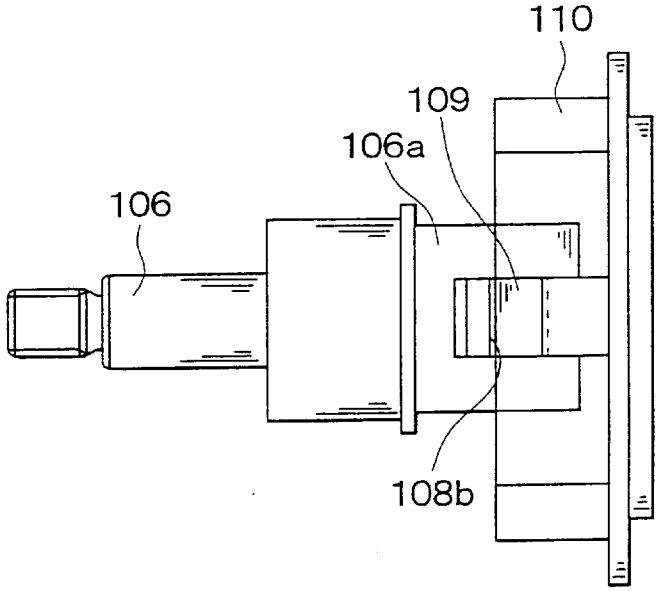
FIG. 12 is a partial plan view corresponding to the view of FIG. 10.
Figure 13:
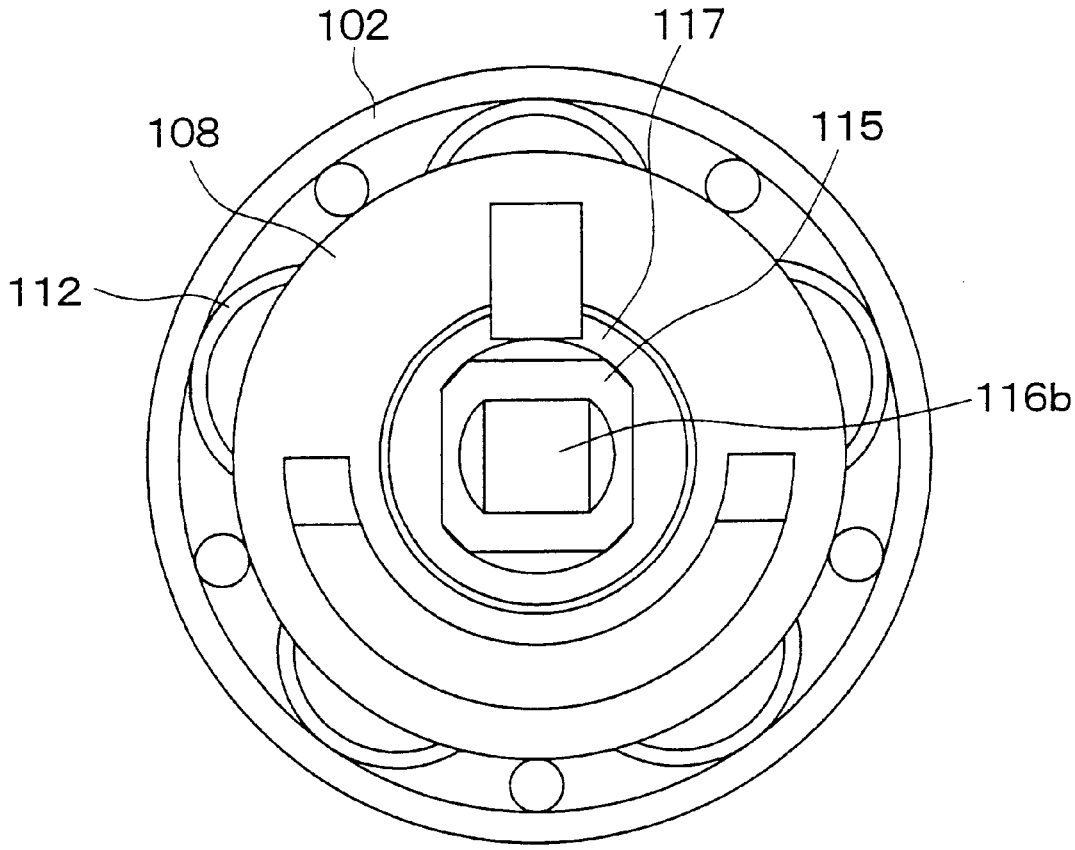
FIG. 13 is a front view showing a movable parts assembly of the compressor according to the first embodiment of the invention.

FIG. 7 shows the front housing member 101 attached to the shaft 106 (this assembly will be called a front assembly. FIG. 9 and FIG. 10 show how the middle housing member 102 (cylinder bore 103) assembled with movable members such as the inclining member 108, the oscillating member 110, and the rod 113. (this assembly will be called a movable parts assembly), is mounted onto the front assembly. FIG. 11 is a drawing showing the state of the shaft 106 and the inclining member 108, in the state shown in FIG. 9, and FIG. 12 is a drawing showing the state of the shaft 106 and the inclining member 108, in the state shown in FIG. 10. FIG. 13 is a front view showing the movable portion assembly from the front housing member 101 side.

The movable parts assembly is mounted onto the front assembly (arms 106*a*), by having the link pin 109 inserted into the linking groove 108*b*, from the opening portion 108*c* of the linking groove 108*b*, as shown in FIG. 9 and FIG. 10.

The linking groove 108*b* is open; that is, an opening 108*c* exists at one end of the linking groove 108*b*, and it is possible to easily assemble the movable portion assembly onto the front assembly (arms 106*a*) by fitting the link pin 109 in the linking groove 108*b*, from the opening portion 108*c* of the linking groove 108*b*, as shown in FIG. 9 and FIG. 10, even when the degree of freedom in movement of the inclining member is, in general, comparatively small during the installation. Therefore, it is easier to connect the assembly that includes the inclining members (inclining member 108 and oscillating member 110) and a plurality of pistons 112 to the arms 106*a*.

In a compressor (not illustrated) in which both ends of the drive shaft are respectively supported by the front housing member and the middle housing member, there is a need to conduct a centering operation (aligning the bearing on the front housing member with the center of the bearing on the middle housing member). That is, it is necessary to connect the assembly of the inclining members (inclining member 108 and oscillating member 110) and the plurality of pistons 112 to the arms 106*a* while maintaining a state in which the center of the bearing on the front housing member is in line with the center of the bearing on the middle housing member.

In the illustrated embodiment, as compared to a compressor in which both ends of the drive shaft are supported, the shaft 106 is supported in a rotatable manner only by the bearing 107 on the front housing member 101 (cantilever construction), and there is only a need to center the shaft 106 with respect to the front housing member 101.

Therefore, in the illustrated embodiment, connecting the inclining members (inclining member 108 and oscillating member 110) with the plurality of pistons 112 mounted to the arm is easier, because there is no need to align the bearing on the front housing member 101 with the center of the bearing on the middle housing member 102.

Second Embodiment

Figure 14:
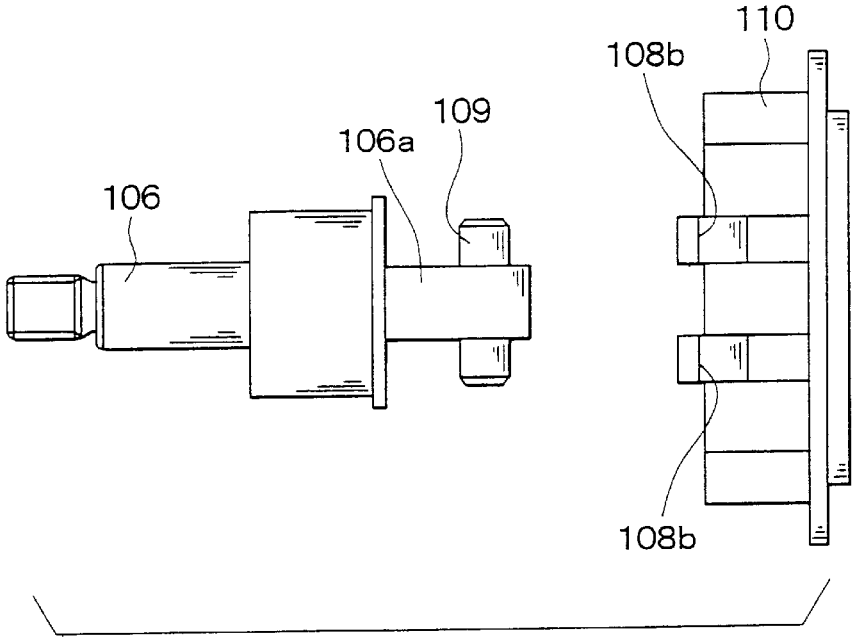
FIG. 14 is a partial plan view like FIG. 11 according to a second embodiment.
Figure 15:
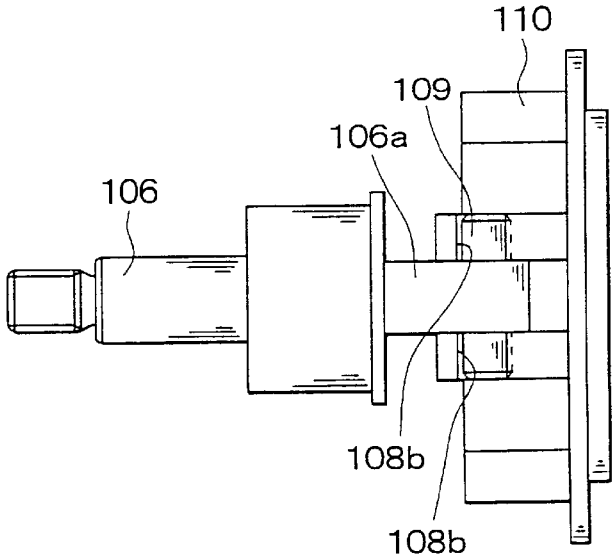
FIG. 15 is a partial plan view like FIG. 12 according to the second embodiment.

In the figures, the same or like parts are given the same or like reference numerals in multiple embodiments and the common parts are not described fully in the description of each embodiment to avoid redundancy. In the first embodiment, there were two arms 106*a*, and the link pin 109 was arranged so that it bridged the two arms 106*a*, and there was only one linking groove 108*b*, as shown in FIG. 11 and FIG. 12. In this embodiment, unlike the first embodiment, there is only one arm 106*a*, and the ends of the link; pin 109 extend respectively from opposite sides of the arm 106*a*, and there are two 20 linking grooves 108*b* corresponding to the ends of the pin 109 as shown in FIG. 14 and FIG. 15.

Third Embodiment

In the first two embodiments, the linking groove or grooves 108*b* were provided on the inclining member 108. In this embodiment, linking grooves 108*b* are provided on the ends of a pair of arms 106*a*, and a link pin 109 is fixed to the inclining member 108, as shown in FIG. 16 and FIG. 17.

In this embodiment, the openings 108*c* of the linking grooves 108*b* face towards the shaft 106, unlike the first and second embodiments.

Figure 16:
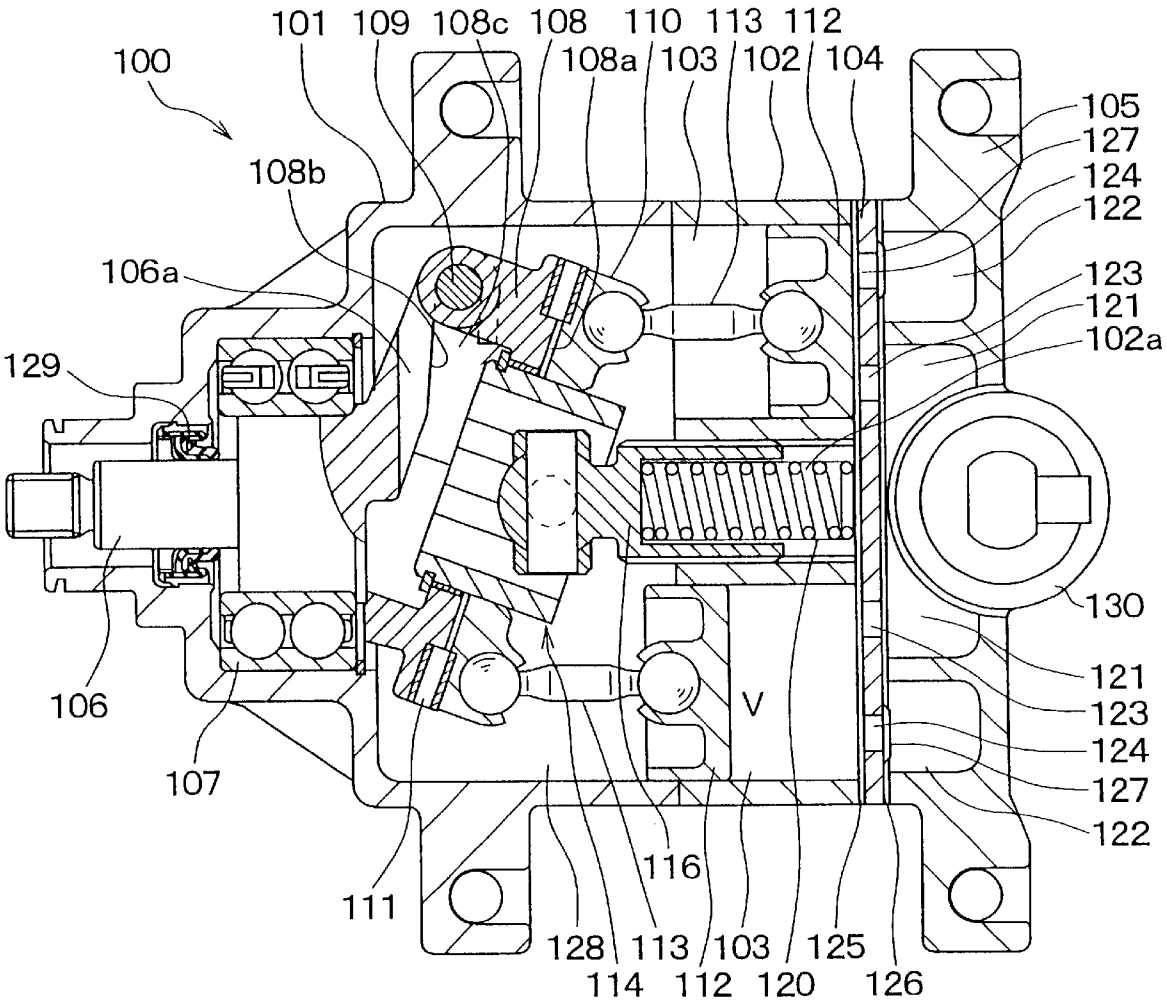
FIG. 16 is a cross sectional view of a compressor according to a third embodiment, during maximum displacement operation.
Figure 17:
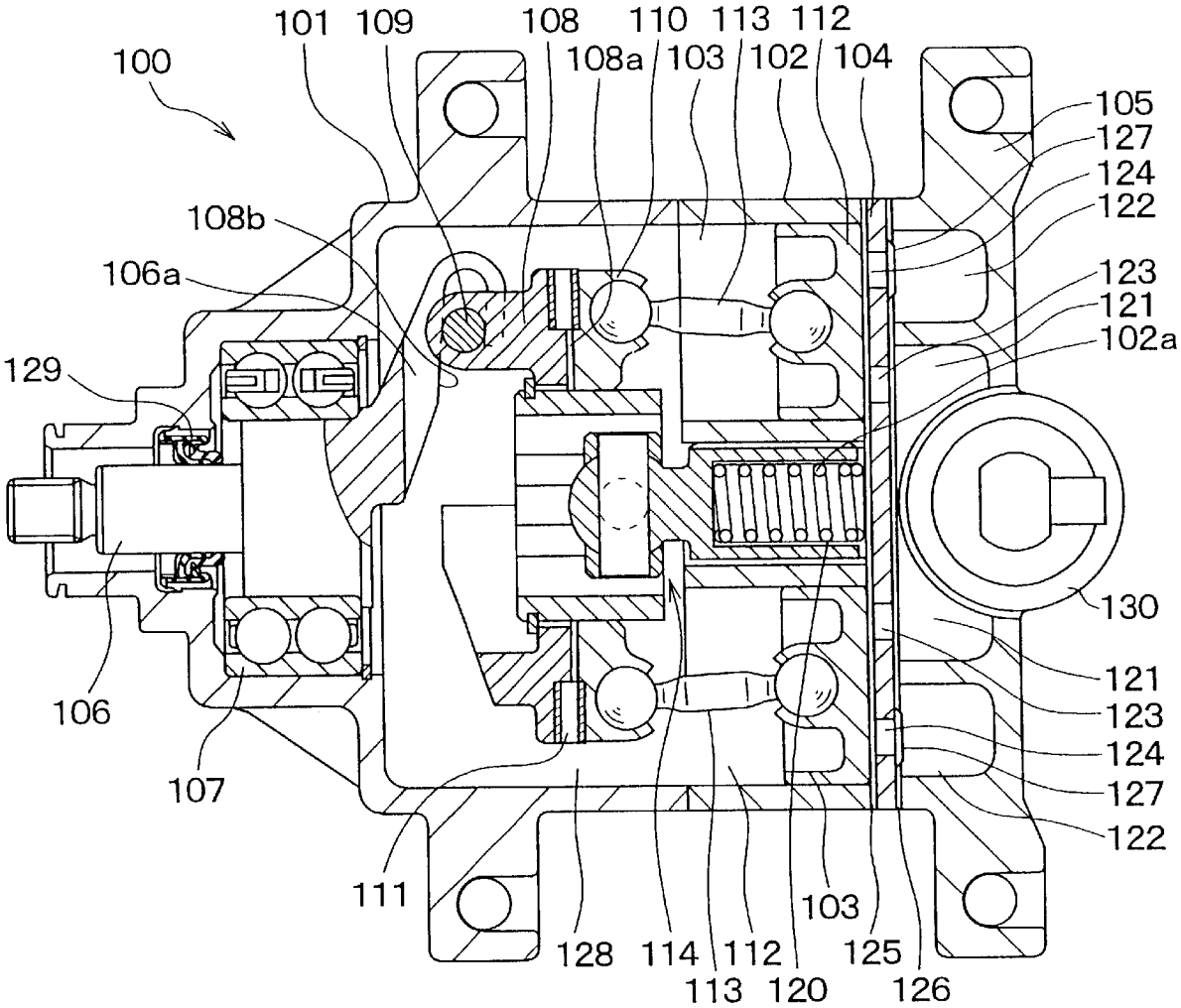
FIG. 17 is a cross sectional view of the compressor of FIG. 16 during minimum displacement operation.
Figure 18:
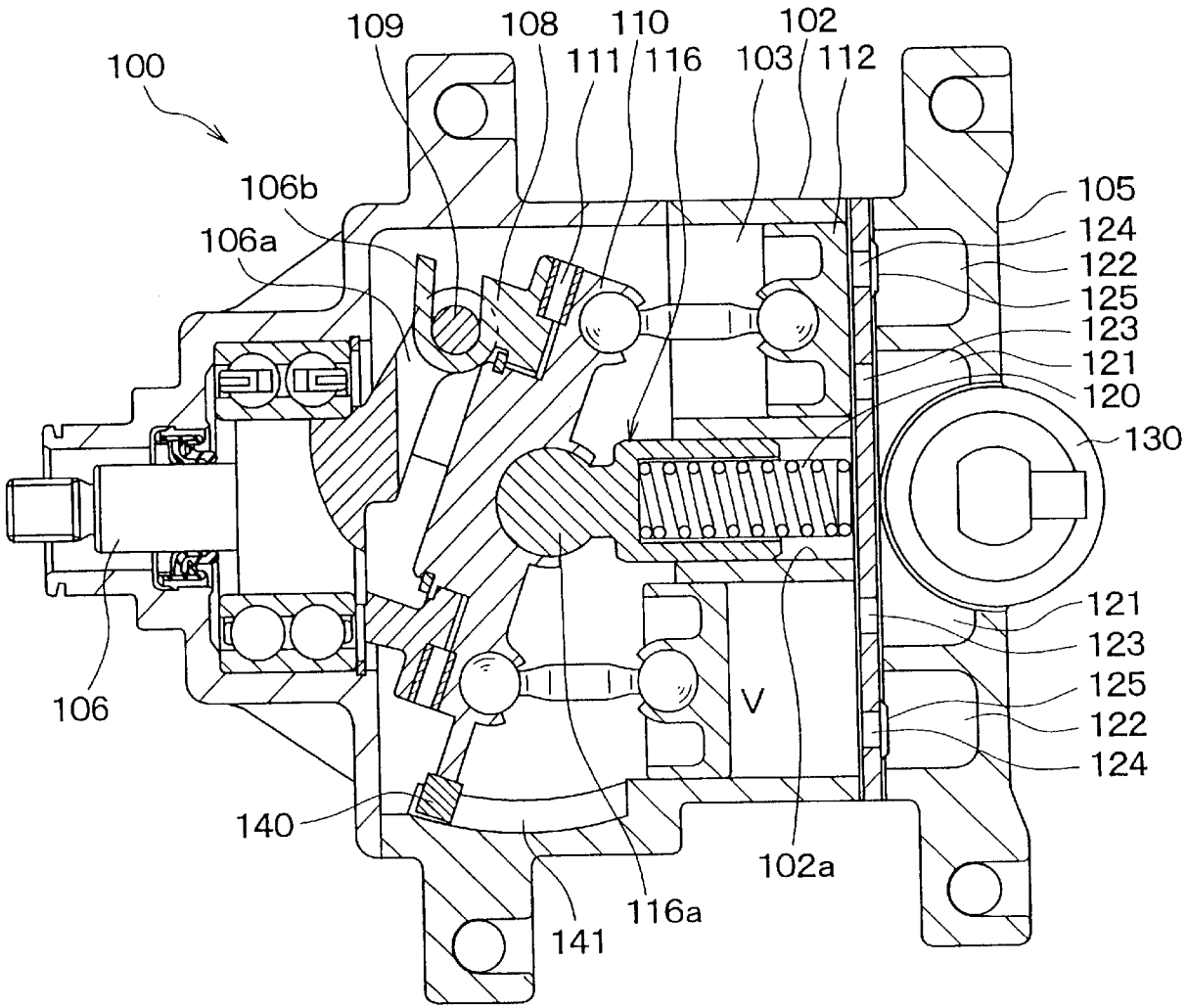
FIG. 18 is a cross sectional view of a compressor according to another variation of the invention.

FIG. 16 shows maximum displacement operation, and FIG. 17 shows minimum displacement operation.

Fourth Embodiment

Figure 19:
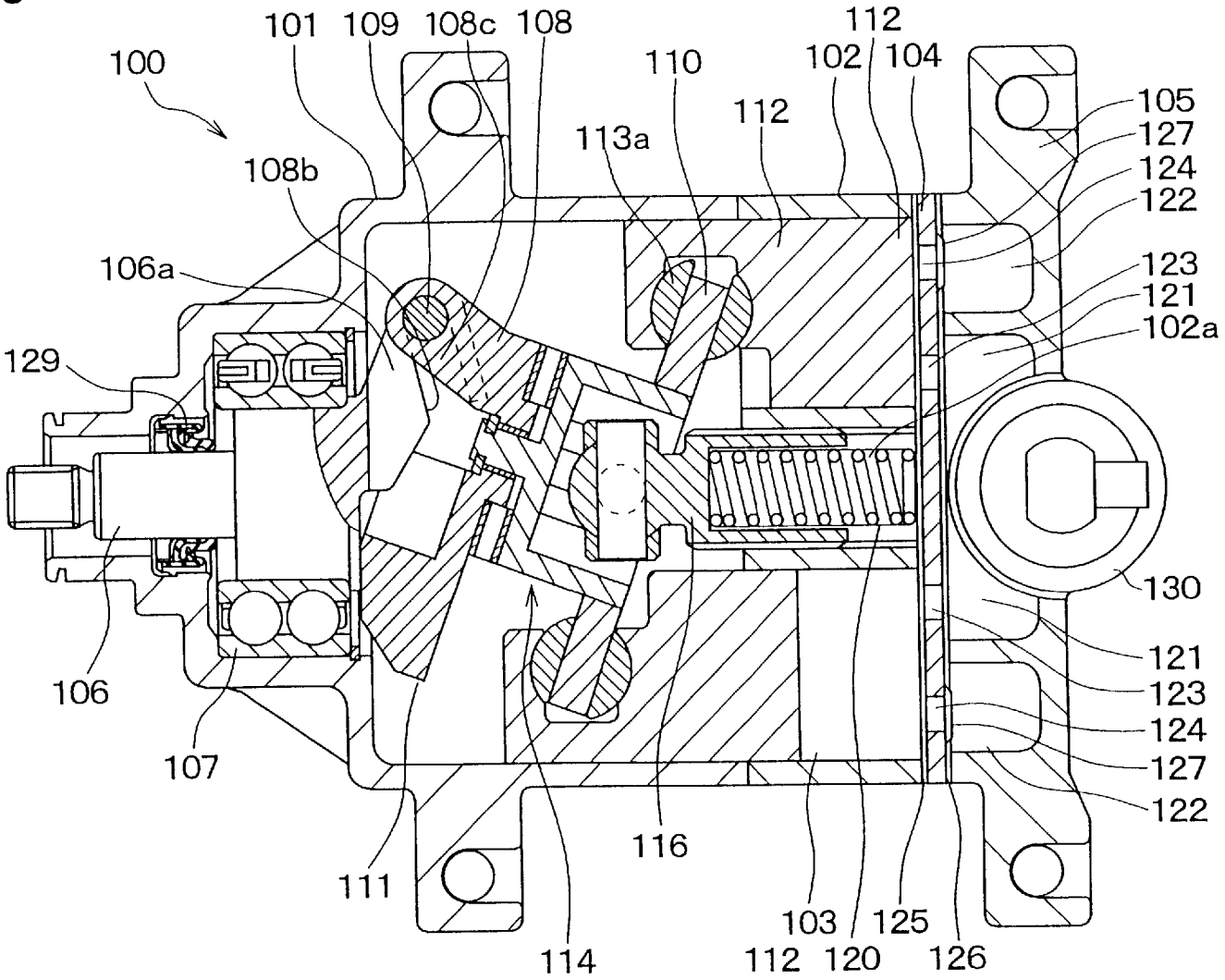
FIG. 19 is a cross sectional view of a compressor-according to yet another variation of the invention.
Figure 20:
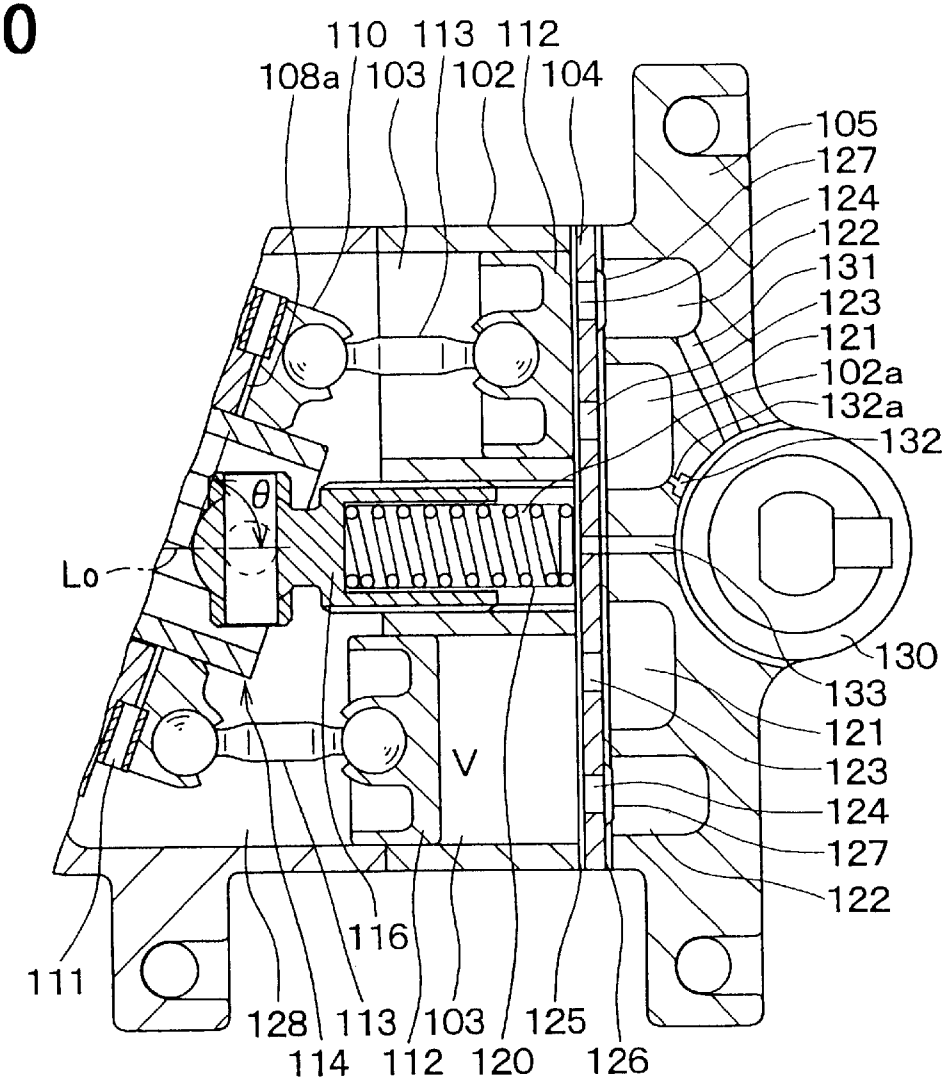
FIG. 20 is a partial cross sectional view of the compress according tool fourth embodiment of the invention during maximum displacement operation.

Referring to FIG. 20, reference symbol 131 denotes a discharge pressure guide hole that guides discharged refrigerant (at discharge pressure Pd) from the discharge chamber 122. Reference symbol 132 denotes a suction pressure guide hole that conducts refrigerant gas at control pressure Pc into the suction chamber 121. Reference symbol 133 denotes a control pressure guide hole that connects the controlled pressure chamber 102*a* and the control valve 130. Reference symbol 132*a* denotes a throttle that produces a prescribed pressure loss (passage resistance) at the suction pressure guide hole 132. The front end of the compressor 100 is not fully illustrated in FIGS. 20 and 23, since the front of the compressor may be like any oft those shown in previous figures, such as FIGS. 2, 6 and 16–19.

In this embodiment, the control valve 130 is controlled by an electronic control unit (ECU) 134. The following is a description of the operation of the compressor 100 of FIG. 20.

Figure 21:
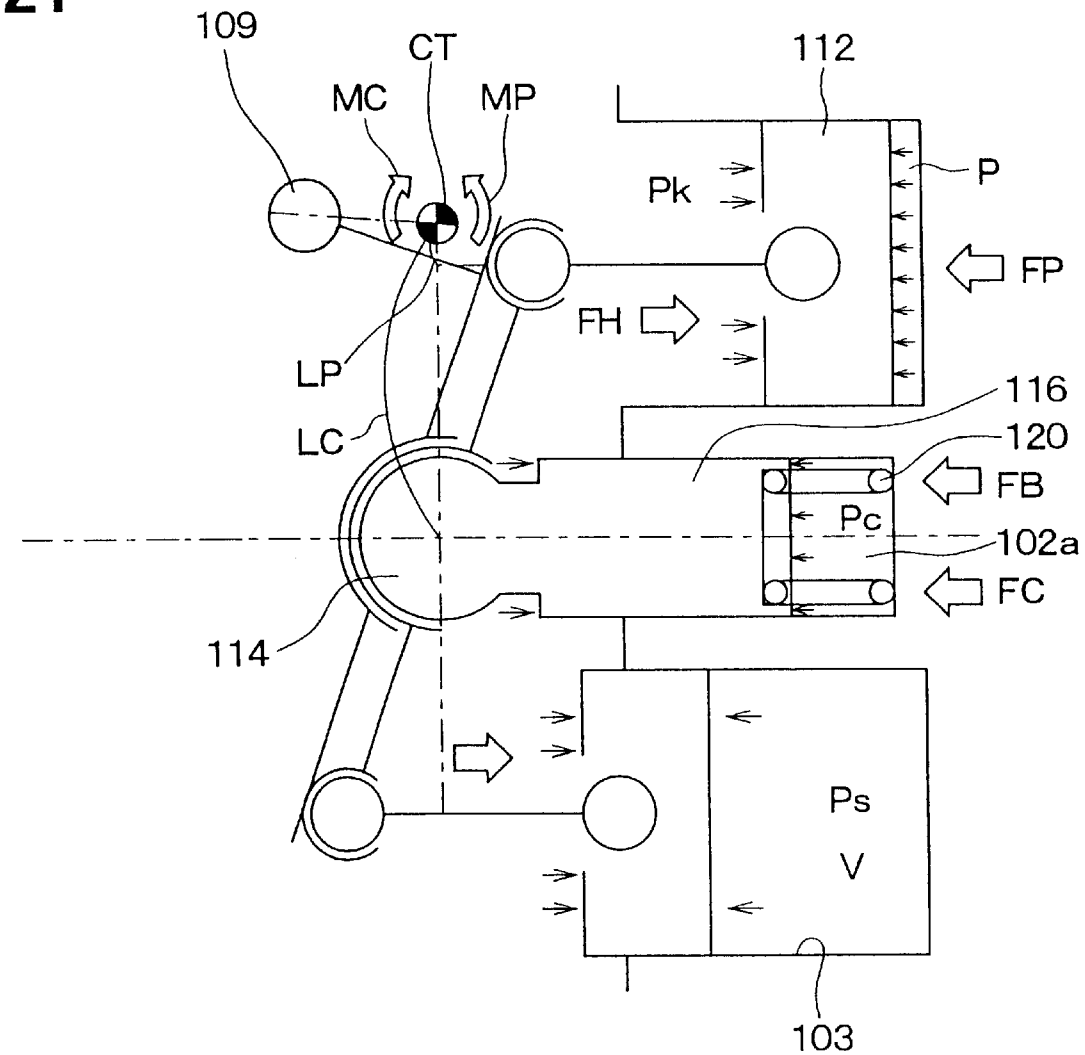
FIG. 21 is a diagram showing operation of the variable displacement mechanism of the compressor of FIG. 20.

FIG. 21 is a schematic view showing the movable parts, such as the piston 112 and the oscillation support mechanism 114. A force FP, applied in the direction of expanding the volume of the compression chamber V and caused by the pressure P inside the compression chamber V, acts upon each piston 112 in the compression stroke. On the other hand, a force FP in the direction of expanding the volume of the compression chamber V is applied by the suction pressure Ps upon the piston 112 in the suction stroke.

The pressure inside the crankcase 128 is higher than the suction pressure Ps and lower than the discharge pressure Pd (pressure P inside the compression chamber V during the compressing process), because refrigerant leaks into the crankcase 128 (blow-by gas) through the gap between the piston 112 and the cylinder bore 103 (this pressure; will be called intermediate pressure Pk). The pressure inside the crankcase 128 applies forces FH upon each of the pistons 112 in the direction of reducing the volume of the compression chamber V.

Since the oscillating member 110 is constrained by the oscillation support mechanism 114 and the link pin 109, the compression reaction force FP and the pressure inside the crankcase 128 (intermediate pressure Pk) apply a moment to the oscillating member 110 (this moment will be called a reducing moment MP (MP=Σ(FP−FH)×LP)). The term LP refers to the length of the moment arm. The reducing moment is centered at an instantaneous center CT. The reducing moment MP is applied in a direction such that the reducing moment MP tends to reduce the displacement.

In this embodiment, the shape of the groove 108*b* is chosen so that the length of the arm LP of the reducing moment MP increases as the displacement increases (as the inclination angle θ decreases), and so that the top dead center of the piston 112 (the position of the piston 112, when the volume of the compression chamber V is minimized) is approximately constant, regardless of the displacement.

A force FC due to the control pressure Pc and an elastic force FB due to the coil spring 120 act in the direction of enlarging the volume of the controlled pressure chamber 102*a* upon the end of the constraining member 116. On the other hand, a force FH in the direction of reducing the volume of the controlled pressure chamber 102*a* acts upon the other end of the constraining member 116, due to the pressure Pk inside the crankcase 128.

Therefore, the constraining member 116 applies a moment that changes the inclination angle θ of the oscillating member 110 (this moment will be called an enlarging moment MC (MC=Σ(FB+FC−FH)×LC), hereinafter) on the oscillating member 110, when the constraining member 116 is moved in the direction of the center axis $L_0$. When the constraining member 116 moves, the control pressure Pc generates an enlarging moment MC through the constraining member 116 in the direction of increasing the displacement (decreasing the inclination angle). Hence the direction of the enlarging moment MC is called positive, when it tends to increase the displacement (decrease the inclination angle θ).

In other words, the constraining member 116 functions as a control piston that controls the inclination angle θ of the oscillating member 110. The control piston 116 applies an enlarging moment MC to the oscillating member 110, which is opposite to the reducing moment MP).

Maximum Displacement Operation

Figure 22A:
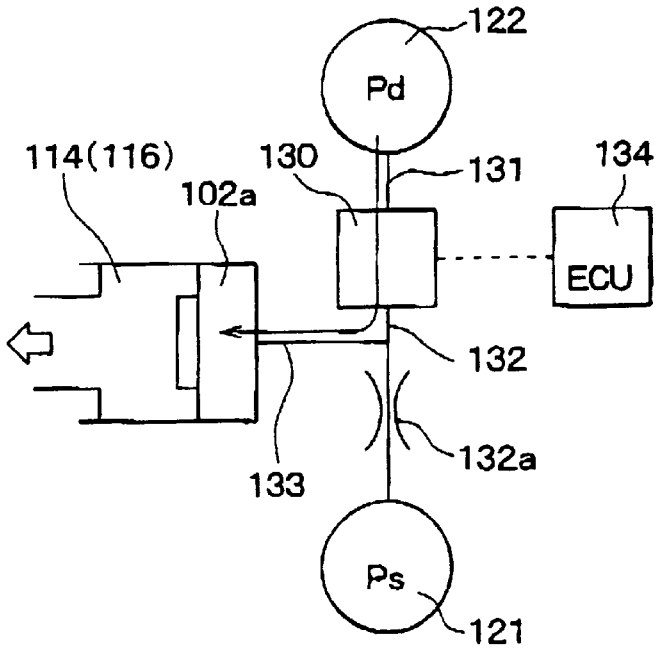
FIG. 22A is a diagram showing control valve activation for the variable displacement mechanism of the compressor of FIG. 20 when the displacement is being increased.

Referring to FIG. 20 and FIG. 22A, the discharge pressure Pd is transmitted to the controlled pressure chamber 102*a* (control pressure Pc=discharge pressure Pd), by adjusting the control valve 130, as shown in FIG. 22A. As a result, the enlarging moment MC is increased, and the inclination angle θ is reduced (displacement is increased).

Variable Displacement Operation

Figure 22B:
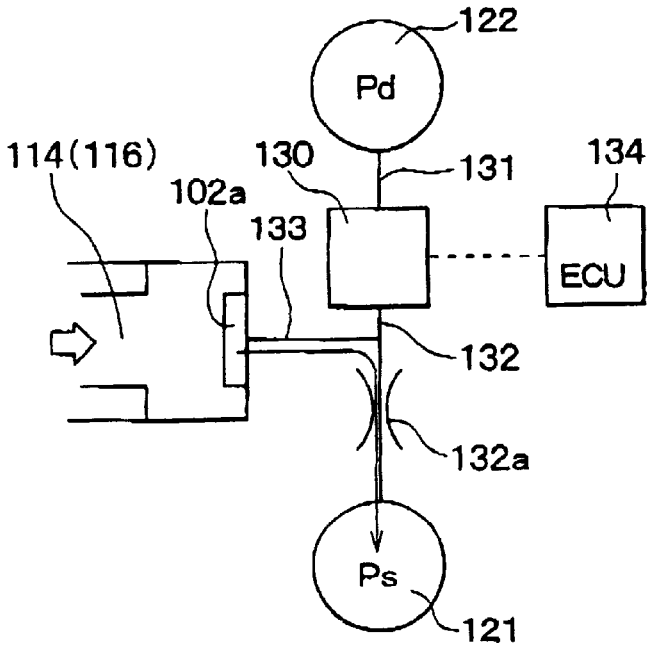
FIG. 22B is a diagram showing control valve activation for the variable displacement mechanism of the compressor of FIG. 20 when the displacement is being decreased.
Figure 23:
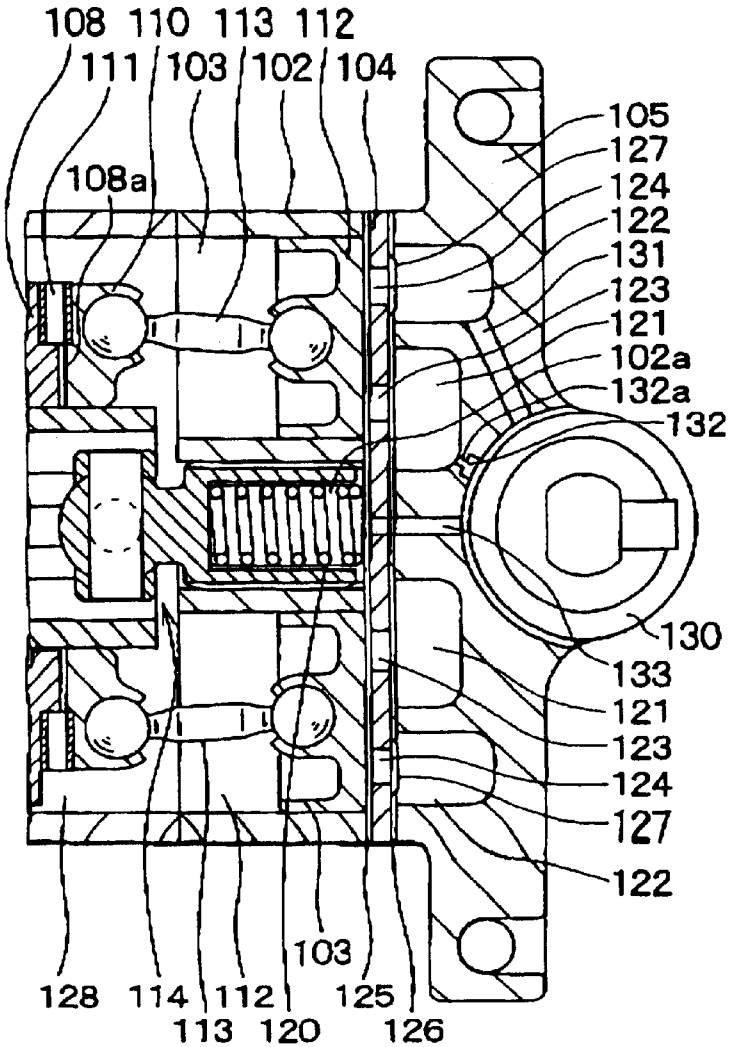
FIG. 23 is a partial cross sectional view of the compressor of FIG. 20 during minimum displacement operation.

Referring to FIG. 23 and FIG. 22B, the pressure inside the controlled pressure chamber 102*a* is lowered (provided that the control pressure Pc is greater than the suction pressure Ps), by adjusting the pressure control valve 130, as shown in FIG. 22B. As a result, the enlarging moment MC decreases, which increases the inclination angle θ (decreases the displacement). At this point, the reducing moment MP gradually decreases, making: the inclination angle θ bigger (reducing the displacement), until the enlarging moment MC and the reducing moment MP becomes equal.

The following is a description of the advantages and effects of this embodiment. The constraining member 116 functions as a control piston that controls the inclination angle θ of the oscillating member 110 (applies an enlarging moment MC upon the oscillating member 110, opposite to the reducing moment MP), by applying the control pressure Pc, which moves the constraining member 116 in the direction of the center axis $L_0$, in the axial direction of the constraining member 116. Hence, the volume of the controlled pressure chamber 102*a* can be adjusted.

On the other hand, the volume of the crankcase 128 must be sufficient to accommodate the movable parts, such as the oscillating member 110, and the crankcase 128 is much larger than necessary for causing the constraining member 116 operate as a control piston.

Therefore, in this embodiment, it is possible to change the control pressure Pc with the control valve 130 with good responsiveness (quickly), to change the capacity of the compressor 100, because it is only necessary to control the pressure inside the controlled pressure chamber 102*a*, without considering the amount of blow-by gas.

The control valve 130 is simple and small, because the volume the controlled pressure chamber 102*a* is small, and the flow rate of refrigerant controlled by the control valve 130 is relatively small.

Fifth Embodiment

Figure 24:
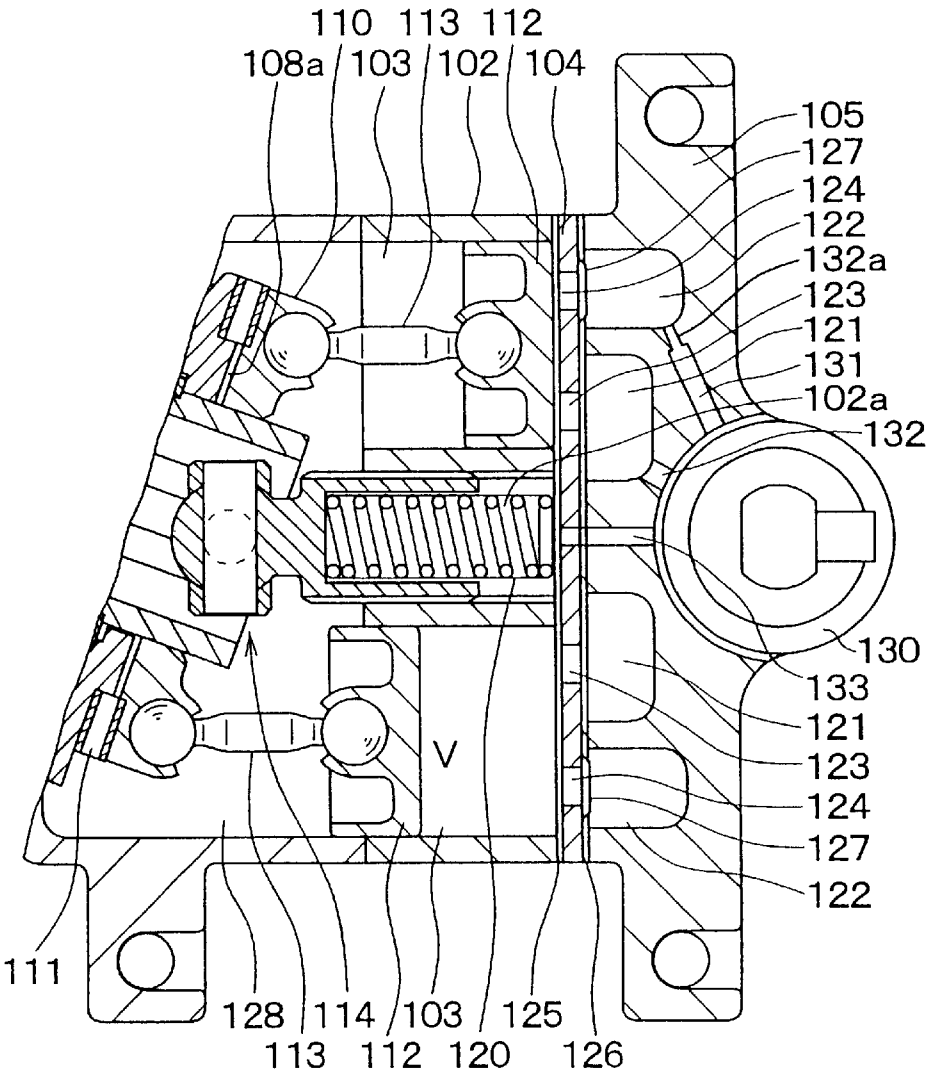
FIG. 24 is a partial cross sectional view of a compressor according to a fifth embodiment.
Figure 25:
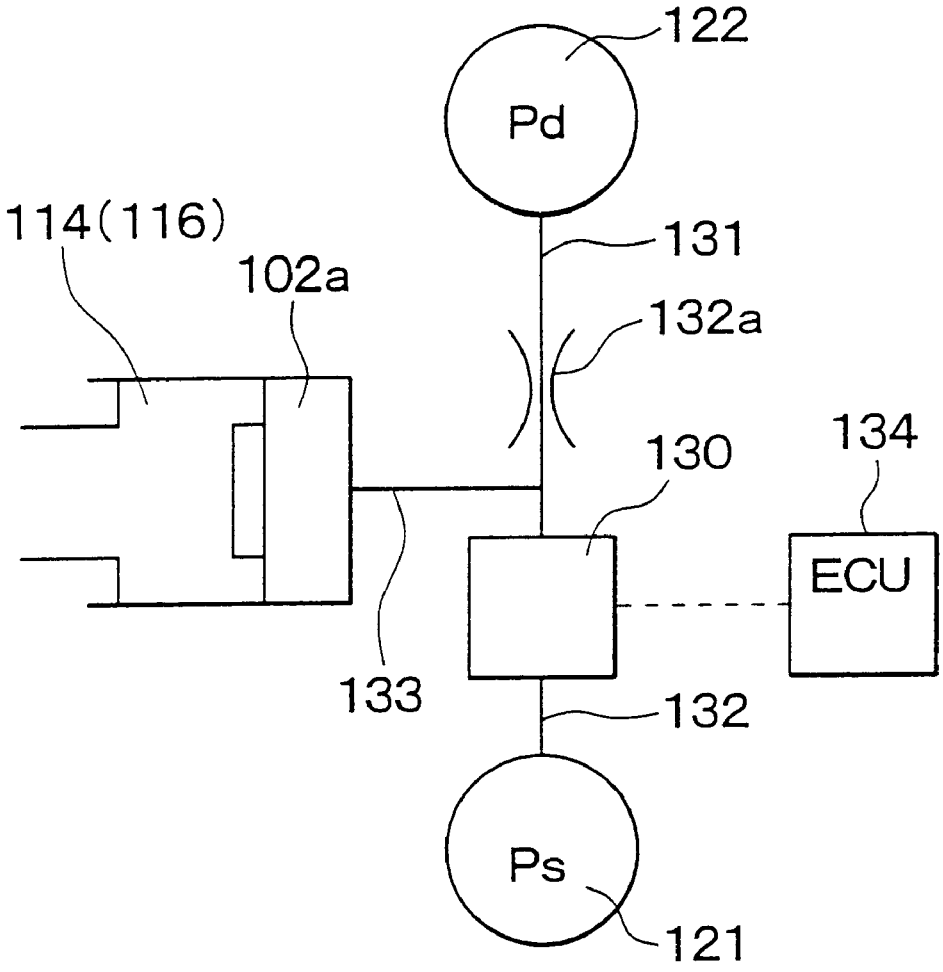
FIG. 25 is a diagram showing control valve activation of the variable displacement mechanism of the compressor of FIG. 24.

In the fourth embodiment, the throttle 132*a* was provided in the suction pressure guide hole 132, but in this embodiment, the throttle 132*a* is provided at the discharge pressure guide hole 131, as shown in FIG. 24 and FIG. 25.

The front end of the compressor 100 is not illustrated in FIG. 24, since the front of the compressor may be like any of those shown in previous figures, such as FIGS. 2, 6 and 16–19.

Sixth Embodiment

Figure 26:
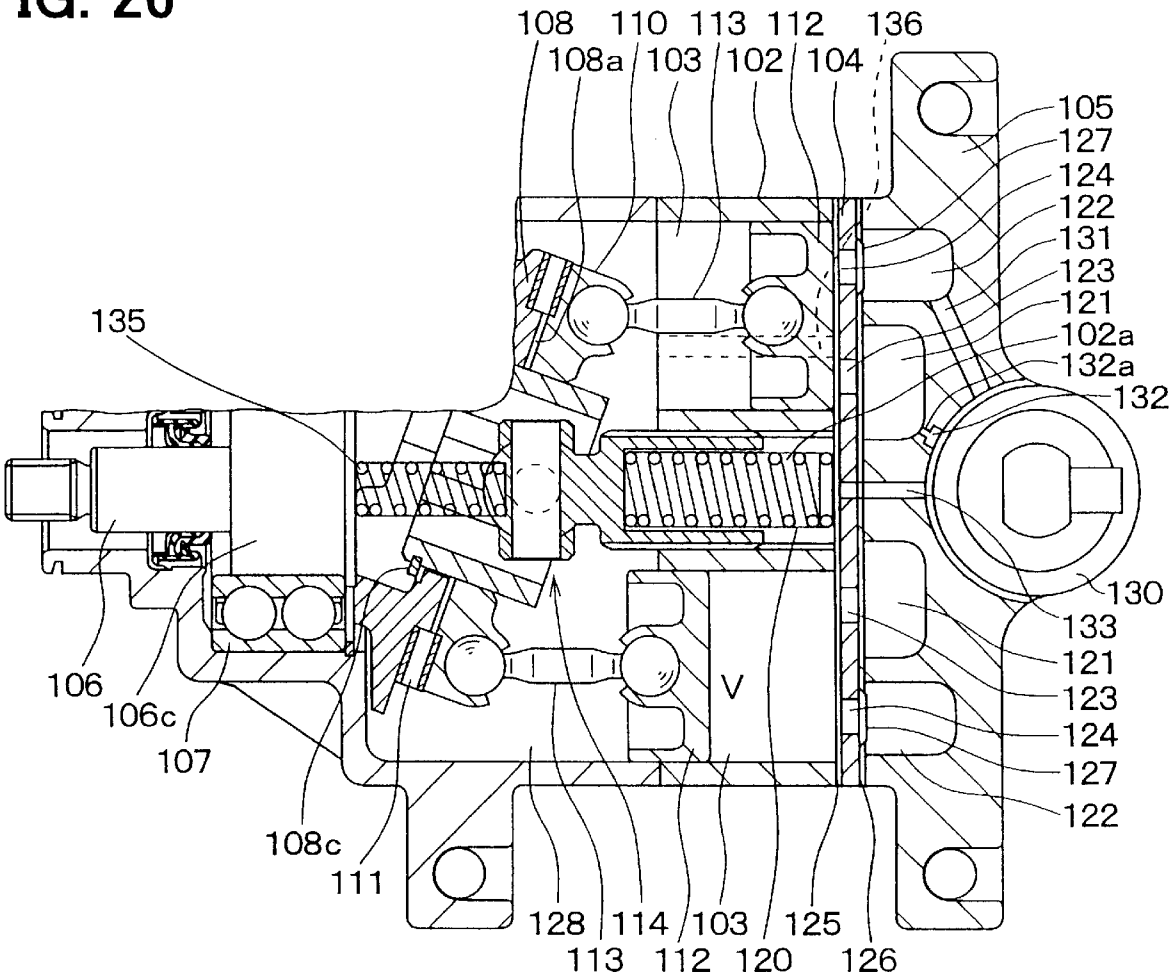
FIG. 26 is a partial cross sectional view of a compressor according to a sixth embodiment during maximum displacement operation.

In the fourth and fifth embodiments, the constraining member (control piston) 116 was positioned by the balance between the force FC, due to the control pressure Pc, and the elastic force FB, due to the coil spring 120, and the force FH, due to the pressure Pk inside the crankcase 128. But in this embodiment, a second coil spring 135, which applies an elastic force FB2 upon the constraining member (control piston) 116, and the elastic force FB2 opposes the force FC and the elastic force FB, as shown in FIG. 26. A pressure release passage 136, which connects the crankcase 128 with the suction (suction chamber 121), is also provided in this embodiment, as shown in FIG. 26.

The front end of the compressor 100 is not, illustrated in FIG. 26, since the front of the compressor may be like any of those shown in previous figures, such as FIGS. 2, 6 and 16–19.

The second coil spring 135 is located between the base diameter portion 106*c* (the portion supported by, the radial bearing 107) of the shaft 106, and the head portion 116*a* of the constraining member 116.

The following is a description of the features of this embodiment. In the fourth and fifth embodiments, the constraining member (control piston) 116 was positioned by the balance between the force FC, the elastic force FB, and the force of the pressure Pk inside the crankcase 128. Hence, when the pressure Pk inside the crankcase 128 is lowered to an excessive degree (lowered to the suction pressure Ps), there is a fear that the constraining member (control piston) 116 might not be moved in the direction such that the volume of the controlled pressure chamber 102*a* is reduced, even when the control pressure Pc is lowered.

In this embodiment, unlike the fourth and fifth-embodiments, the force FC of the control pressure Pc and the elastic force FB of the coil spring 120 are opposed by the second coil spring 135. Hence the constraining member (control piston) 116 can be positively displaced in the direction in which the volume of the controlled pressure chamber 102*a* is reduced, even when the pressure Pk inside the crankcase 128 is lowered by the pressure release passage 136 to approximately the level of the suction pressure Ps.

Refrigerant, at the suction side, in which lubricating oil is mixed, can be guided to the movable parts (sliding parts) in the crankcase 128, such as the oscillating member 110 and the inclining member 108, because the constraining member (control piston) 116 can be positively displaced in the direction in which the volume of the controlled pressure chamber 102*a* is reduced, even when the pressure Pk inside the crankcase 128 is lowered by the pressure release passage 136 to approximately the level of the suction pressure Ps. Therefore, the reliability (durability) of the compressor 100 is improved, because the movable parts (sliding parts) can be lubricated reliably.

Seventh Embodiment

Figure 27:
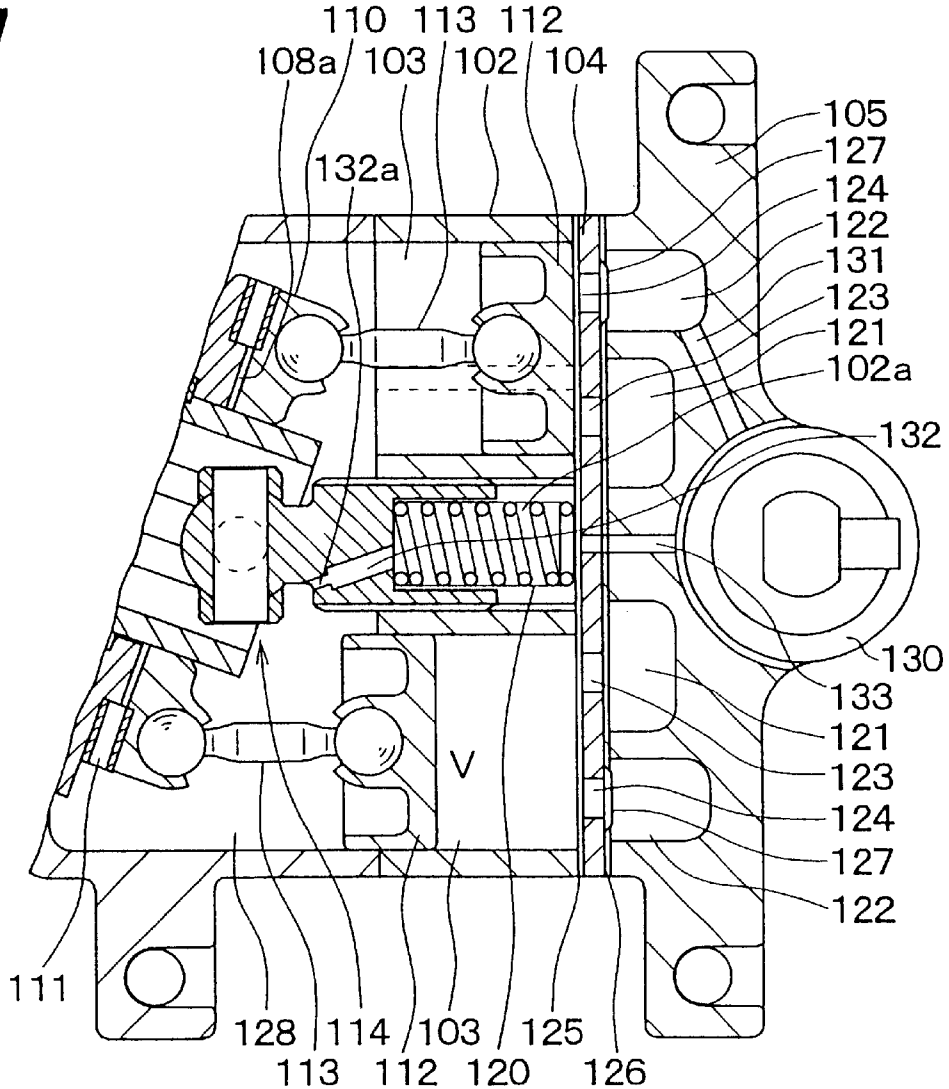
FIG. 27 is a partial cross sectional view of a compressor according to a seventh embodiment.

This embodiment is a modification of the sixth embodiment, and to be specific, the suction chamber and the controlled pressure chamber 102*a* are connected indirectly, by forming the suction pressure guide hole 132 and the throttle 132*a* in the constraining member 116, to connect the crankcase 128 and the controlled pressure chamber 102*a* in FIG. 27.

The front end of the compressor 100 is not illustrated in FIG. 27, since the front of the compressor may be like any of those shown in previous figures, such as FIGS. 2, 6 and 16–19.

By doing this, it is easier to form (manufacture) the suction pressure guide hole 132 and the throttle 132*a*, in comparison to forming the suction pressure guide hole 132 and the throttle portion 132*a* in the rear housing member 105.

Eight Embodiment

Figure 28A:
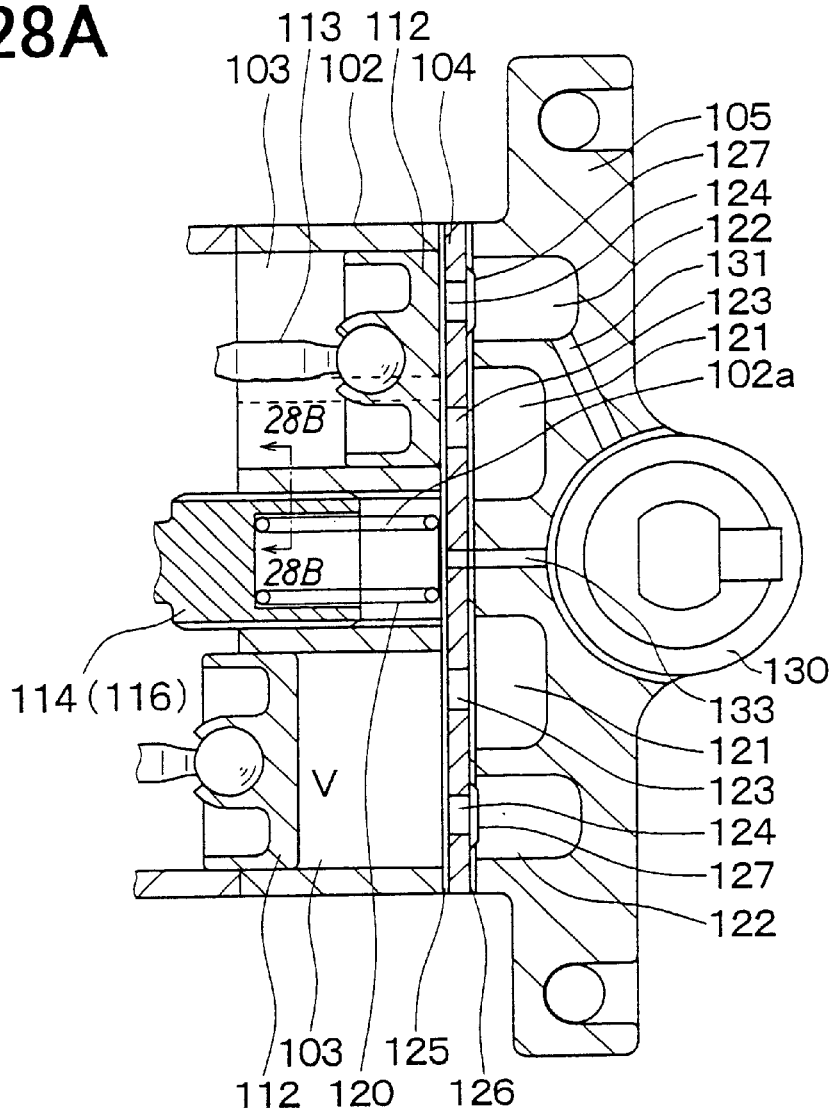
FIG. 28A is a partial cross sectional view of a compressor according to an eighth embodiment of the invention.
Figure 28B:
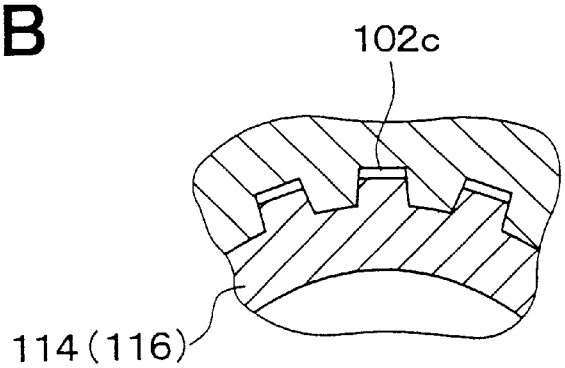
FIG. 28B is a partial cross sectional view of a compressor taken along plane 28B—28B of FIG. 28A.

This embodiment is a modification of the seventh embodiment, and to be specific, the suction pressure guide hole 132 and the throttle 132*a*, which are provided in the constraining member 116 of the seventh embodiment, are formed in the eighth embodiment by providing an appropriate gap 102*c* between the outer surface of the constraining member 116 and the inner surface of the hole 102*a* (controlled pressure chamber 102*a*), as shown in FIGS. 28A and 28B.

The front end of the compressor 100 is not illustrated in FIG. 28A, since the front of the compressor may be like any of those shown in previous figures, such as FIGS. 2, 6 and 16–19.

By doing this, it is even easier to form (manufacture) the suction pressure guide hole 132 and the throttle 132*a*, in comparison to forming the suction pressure guide hole 132 and the throttle portion 132*a* on the rear housing member 105.

Other Embodiments

In the illustrated embodiments, the oscillation support mechanism 114 has a universal joint in the form of a Hooke's joint. However, the invention is not so limited, and the oscillation support mechanism 114 can be for example, a joint with connected rolling elements, such as a constant-velocity ball joint, or the head portion 116*a* of the constraining member 116 can be a spherical sliding shoe, which supports the oscillating member 110. Reference symbol 140 in FIG. 18 denotes a whirl-stop portion that prevents the oscillating member 110 from rotating with the shaft 106, and reference symbol 141 denotes a guide groove that guides the oscillation of the whirl-stop arm 140.

In the illustrated embodiments, the wobble type pump of to the invention was applied to a compressor for a vapor-compression type refrigeration cycle. However, the invention is not limited to this application, and it can be applied to other fluid pumps and compressors.

In the first three embodiments, the inclination angle θ of the oscillating member 110 (inclining member 108) was controlled by controlling the pressure inside the crankcase 128. The invention is not so limited and the inclination angle θ can be controlled by controlling the pressure inside the chamber 102*a* as discussed in the fourth and subsequent embodiments.

In the illustrated embodiments, the oscillating member 110 and the pistons 112 were connected by rods 113. However, the oscillating member 10 and the pistons 112 can be connected by semispherical shoes 113*a*, as shown in FIG. 19.

What is claimed is:

1. A variable displacement compressor, in which displacement is varied by changing the strokes of a plurality of reciprocating pistons by changing the inclination of an inclining drive member relative to the axis of a shaft the compressor comprising:

a housing for accommodating the shaft and the inclining drive member, wherein the housing includes a first housing member having a bearing for supporting the shaft such that the shaft is supported within the housing by only the bearing on the first housing member, and a second housing member having a plurality of cylinder bores for accommodating the pistons; and an arm for transmitting torque from the shaft to the inclining drive member, such that the inclining drive member oscillates when driven, wherein a coupling between the arm and the inclining drive member includes a linking groove, which is provided on one of the arm and the inclining drive member, and a link pin, which is attached to the other of the arm and the inclining drive member, wherein the link pin is fitted in and slides within the linking groove such that the inclining drive member can move radially with respect to the axis, and the linking groove is open at one end to receive the linking pin.

2. The variable displacement compressor of claim 1, wherein the linking groove is generally U-shaped.

3. The variable displacement compressor according to claim 2 further comprising a control piston, which is connected to the inclining member, for applying a moment to the inclining member in a direction opposite to that of a moment applied to the inclining member by the pistons.

4. The variable displacement compressor according to claim 3, wherein the control piston is connected to the inclining member at a location close to a point of intersection between the axis and the inclining member.

5. The variable displacement compressor of claim 2 further comprising:

an oscillating member connected to the inclining member trough a thrust bearing, wherein the oscillating member causes the pistons to reciprocate; and an oscillation support mechanism in the form ala universal joint, for supporting the oscillating, wherein the oscillation support mechanism comprises:

a first rotating member, wherein the first rotating member rotates about a first axis, which intersects the axis of the shaft at right angles;

a constraining member, which is connected to the first rotating member, wherein the constraining member prevents the first rotating member from rotating around the axis of the shaft, and the constraining member is axially movable, and a control pressure urges the constraining member axially; and a second rotating member, which is connected to the first rotating member and rotates with respect to the first rotating member about a second axis, which intersects the axis of the shaft and the first axis at right angles, wherein the oscillating member is attached to the second rotating member.

6. The variable displacement compressor according to claim 5; wherein the oscillating member is annular, and the oscillation support mechanism is located at a central portion of the oscillating member.

7. The variable displacement compressor according to claim 5, wherein the compressor further comprises:

a suction chamber;

a crankcase, in which the inclining member and the oscillating member are located;

a passage connecting the crankcase to the suction chamber; and an urging member for applying an axial force to the constraining member in a direction opposite to the force of the control pressure upon the constraining member.

8. A variable displacement compressor, in which displacement is varied by changing the strokes of a plurality of reciprocating pistons by changing the inclination of an inclining drive member relative to the axis of a shaft, the compressor comprising:

a housing for accommodating the shaft and the inclining drive member, wherein the housing includes a first housing member having at least one bearing for supporting the shaft such that the shaft is supported within the housing by only the at least one bearing an the first housing member, and a second housing member having a plurality of cylinder bores for accommodating the pistons; and an arm for transmitting torque from the shaft to the inclining drive member, such that the inclining drive member oscillates when driven, wherein a coupling between the arm and the inclining drive member includes a linking groove, which is provided on one of the arm and the inclining drive member, and a link pin, which is attached to the other of the arm and the inclining drive member, wherein the link pin is fitted in and slides within the linking groove such that the inclining drive member can move radially with respect to the axis, wherein the linking groove is open at one end to receive the linking pin and is generally U-shaped.

9. The variable displacement compressor according to claim 4, comprising a control piston, which is connected to the inclining member, for applying a moment to the inclining member in a direction opposite to that of a moment applied to the inclining member by the pistons.

10. The variable displacement compressor according to claim 9, wherein the control piston is connected to the inclining member at a location close to a point of intersection between the axis and the inclining member.

11. The variable displacement compressor of claim 4, further comprising:

an oscillating member connected to the inclining member through a thrust bearing, wherein the oscillating member causes the pistons to reciprocate; and an oscillation support mechanism in the form of a universal joint, for supporting the oscillating, wherein the oscillation support mechanism comprises:

a first rotating member, wherein the first rotating member rotates about a first axis, which intersects the axis of the shaft at right angles;

a constraining member, which is connected to the first rotating member, wherein the constraining member prevents the first rotating member from rotating around the axis of the shaft, and the constraining member is axially movable, and a control pressure urges the constraining member axially; and a second rotating member, which is connected to the first rotating member and rotates with respect to the first rotating member about a second axis, which intersects the axis of the shaft and the first axis at right angles, wherein the oscillating member is attached to the second rotating member.

12. The variable displacement compressor according to claim 11, wherein the oscillating member is annular, and the oscillation support mechanism is located at a central portion of the oscillating member.

13. The variable displacement compressor according to claim 12, wherein the compressor further comprises:

a suction chamber;

a crankcase, in which the inclining member and the oscillating member are located;

a passage connecting the crankcase to the suction chamber; and an urging member for applying an axial force to the constraining member in a direction opposite to the force of the control pressure upon the constraining member.

14. A variable displacement compressor, in which displacement is varied by changing the strokes of a plurality of reciprocating pistons by changing the inclination of an inclining drive member relative to the axis of a shaft, the compressor comprising:

a housing for accommodating the shaft and the inclining drive member, wherein the housing includes a first housing member having at least one bearing for supporting the shaft such that the shaft is supported within the housing by only the at least one bearing on the first housing member, and a second housing member having a plurality of cylinder bores for accommodating the pistons;

an arm for transmitting torque from the shaft to the inclining drive member, such that the inclining drive member oscillates when driven, wherein a coupling between the arm and the inclining drive member includes a linking groove, which is provided on one of the arm and the inclining drive member, and a link pin, which is attached to the other of the arm and the inclining drive member, wherein the link pin is fitted in and slides within the linking groove such that the inclining drive member can move radially with respect to the axis, and the linking groove is open at one end to receive the linking pin; and a control piston, which is connected to the inclining member, for applying a moment to the inclining member in a direction opposite to that of a moment applied to the inclining member by the pistons.

15. The variable displacement compressor of claim 14, wherein the linking groove is generally U-shaped.

16. A variable displacement compressor, in which displacement is varied by changing the strokes of a plurality of reciprocating pistons by changing the inclination of an inclining drive member relative to the axis of a shaft, the compressor comprising:

a housing for accommodating the shaft and the inclining drive member, wherein the housing includes a plurality of cylinder bores for accommodating the pistons;

an arm for transmitting torque from the shaft to the inclining drive member, such that the inclining drive member oscillates when driven, wherein a coupling between the arm and the inclining drive member includes a linking groove, which is provided on one of the arm and the inclining drive member, and a link pin, which is attached to the other of the arm and the inclining drive member, wherein the link pin is fitted in and slides within the linking groove such that the inclining drive member can move radially with respect to the axis, and the linking groove is open at one end to receive the linking pin, and wherein the linking groove is open at one end to receive the linking pin and is generally U-shaped; and a control piston, which is connected to the inclining member, for applying a moment to the inclining member in a direction opposite to that of a moment applied to the inclining member by the pistons.

17. A variable displacement compressor, in which displacement is varied by changing the strokes of a plurality of reciprocating pistons by changing the inclination of an inclining drive member relative to the axis of a shaft, the compressor comprising:

a housing for accommodating the shaft and the inclining drive member, wherein the housing includes a plurality of cylinder bores for accommodating the pistons;

an arm for transmitting torque from the shaft to the inclining drive member, such that the inclining drive member oscillates when driven, wherein a coupling between the arm and the inclining drive member includes a linking groove, which is provided on one of the arm and the inclining drive member, and a link pin, which is attached to the other of the arm and the inclining drive member, wherein the link pin is fitted in and slides within the linking groove such that the inclining drive member can move radially with respect to the axis, and the linking groove is open at one end to receive the linking pin, and wherein the linking groove is open at one end to receive the linking pin and is generally U-shaped;

an oscillating member connected to the inclining member through a thrust bearing, wherein the oscillating member causes the pistons to reciprocate; and an oscillation support mechanism in the form of a universal joint, for supporting the oscillating, wherein the oscillation support mechanism comprises:

a first rotating member, wherein the first rotating member rotates about a first axis, which intersects the axis of the shaft at right angles;

a constraining member, which is connected to the first rotating member, wherein the constraining member prevents the fast rotating member from rotating around the axis of the shaft, and the constraining member is axially movable, and a control pressure urges the constraining member axially; and a second rotating member, which is connected to the first rotating member and rotates with respect to the first rotating member about a second axis, which intersects the axis of the shaft and the first axis at right angles, wherein the oscillating member is attached to the second rotating member.

18. A variable displacement compressor, in which displacement is varied by changing the strokes of a plurality of reciprocating pistons by changing the inclination of an inclining drive member relative to the axis of a shaft, the compressor comprising:

a housing for accommodating the shaft and the inclining drive member, wherein the housing includes a plurality of cylinder bores for accommodating to pistons;

an arm for transmitting torque from the shaft to the inclining drive member, such that the inclining drive member oscillates when driven, wherein a coupling between the arm and the inclining drive member includes a linking groove, which is provided on one of the arm and the inclining drive member, and a link pin, which is attached to the other of the win and the inclining drive member, wherein the link pin is fitted in and slides within the linking groove such that the inclining drive member can move radially with respect to the axis, and the linking groove is open at one end to receive the linking pin; and a control piston, which is connected to the inclining member, for applying a moment to the inclining member in a direction opposite to that of a moment applied to the inclining member by the pistons.

19. A variable displacement compressor, in which displacement is varied by changing the strokes of a plurality of reciprocating pistons by changing the inclination of an inclining drive member relative to the axis of a shaft, the compressor comprising:

a housing for accommodating the shaft and the inclining drive member, wherein the housing includes a plurality of cylinder bores for accommodating the pistons;

an arm for transmitting torque from the shaft to the inclining drive member, such that the inclining drive member oscillates when driven, wherein a coupling between the arm and the inclining drive member includes a linking groove, which is provided on one of the arm and the inclining drive member, and a link pin, which is attached to the other of the arm and the inclining drive member, wherein the link pin is fitted in and slides within the linking groove such that the inclining drive member can move radially with respect to the axis, and the linking groove is open at one end to receive the linking pin;

an oscillating member connected to the inclining member through a thrust bearing, wherein the oscillating member causes the pistons to reciprocate; and an oscillation support mechanism in the form of a universal joint, for supporting the oscillating, wherein the oscillation support mechanism comprises:

a first rotating member, wherein the first rotating member rotates about a first axis, which intersects the axis of the shaft at right angles;

a constraining member, which is connected to the first rotating member, wherein the constraining member prevents the first rotating member from rotating around the axis of the shaft, and the constraining member is axially movable, and a control pressure urges the constraining member axially; and a second rotating member, which is connected to the first rotating member and rotates with respect to the first rotating member about a second axis, which intersects the axis of the shaft and the first axis at right angles, wherein the oscillating member is attached to the second rotating member.

* * * * *